US009387684B2

(12) United States Patent
Ogawa et al.

(10) Patent No.: US 9,387,684 B2
(45) Date of Patent: Jul. 12, 2016

(54) INK JET RECORDING APPARATUS, INK OR SOLVENT CARTRIDGE, AND BOTTLE INCLUDED IN CARTRIDGE

(71) Applicant: Keyence Corporation, Osaka (JP)

(72) Inventors: Junji Ogawa, Osaka (JP); Hiroki Wada, Osaka (JP); Mamoru Idaka, Osaka (JP)

(73) Assignee: Keyence Corporation, Osaka (JP)

( * ) Notice: Subject to any disclaimer, the term of this patent is extended or adjusted under 35 U.S.C. 154(b) by 0 days.

(21) Appl. No.: 14/559,938

(22) Filed: Dec. 4, 2014

(65) Prior Publication Data

US 2015/0197094 A1 Jul. 16, 2015

(30) Foreign Application Priority Data

Jan. 16, 2014 (JP) ..... 2014-006193

(51) Int. Cl.
*B41J 2/175* (2006.01)

(52) U.S. Cl.
CPC ..... *B41J 2/1753* (2013.01); *B41J 2/175* (2013.01); *B41J 2/1752* (2013.01); *B41J 2/17513* (2013.01); *B41J 2/17523* (2013.01); *B41J 2/17546* (2013.01); *B41J 2/17553* (2013.01); *B41J 2002/17516* (2013.01)

(58) Field of Classification Search
CPC ..... B41J 2/02; B41J 2/1753; B41J 2/17546
See application file for complete search history.

(56) References Cited

U.S. PATENT DOCUMENTS

2010/0208013 A1* 8/2010 Zaba et al. ..... 347/86
2010/0220129 A1* 9/2010 Tomlin et al. ..... 347/7

FOREIGN PATENT DOCUMENTS

JP 2007-190724 8/2007
JP 2011-500353 1/2011
WO 2009/047497 A2 4/2009

* cited by examiner

*Primary Examiner* — Kristal Feggins
*Assistant Examiner* — Kendrick Liu
(74) *Attorney, Agent, or Firm* — Kilyk & Bowersox, P.L.L.C.

(57) ABSTRACT

An object is to prevent the occurrence of contact failure between a cartridge equipped with a recording medium and an ink jet recording apparatus. A bottle body is crushed to reduce the volume thereof when an ink or solvent is sucked out of the bottle body. A bottle has a neck and a mouth. The neck is rigid. The ROM unit records therein an ink or solvent type, a serial number, the capacity of the bottle, and the amount of remaining ink or solvent. The ROM unit has first and second arms, and freely movably attached to the neck by the first and second arms. A positioning hole is formed on a ROM holder body which houses therein a recording medium. The positioning hole positions the ROM holder body in cooperation with a positioning pin of a reservoir.

19 Claims, 23 Drawing Sheets

INK JET RECORDING APPARATUS, INK OR SOLVENT CARTRIDGE, AND BOTTLE INCLUDED IN CARTRIDGE

CROSS-REFERENCE TO RELATED APPLICATIONS

The present application claims foreign priority based on Japanese Patent Application No. 2014-006193, filed Jan. 16, 2014, the contents of which is incorporated herein by reference.

BACKGROUND OF THE INVENTION

1. Field of the Invention

The present invention relates to an ink jet recording apparatus, an ink or solvent cartridge, and a bottle included in the cartridge.

2. Description of Related Art

An ink jet recording apparatus is used for printing characters or graphics on the surface of a workpiece (JP 2007-190724 A). The ink jet recording apparatus is generally called "ink jet printer". The ink jet printer includes a head which is placed above a manufacturing line and a controller body which supplies ink to the head. The ink jet printer charges an ink liquid and forms the ink liquid into droplets, and deflects the ink droplets to thereby perform printing on the surface of a workpiece.

In the ink jet recording apparatus disclosed in JP 2007-190724 A, the ink liquid is continuously supplied to the head even when ink droplets are not printed on a workpiece and the supplied ink liquid is collected through a gutter as an ink receiver. That is, the ink jet recording apparatus disclosed in JP 2007-190724 A is a continuous type ink jet printer.

As a method for replenishing an ink jet recording apparatus with an ink or solvent, there are employed many methods in which a reserve tank is installed in an ink jet recording apparatus (JP 2007-190724 A). However, in the methods in which a reserve tank is installed in an ink jet recording apparatus, filling the reserve tank with ink may cause contamination of the surroundings of the reserve tank. In view of such a circumstance, an ink jet recording apparatus that employs a cartridge system using a cartridge which can be attached to and detached from the ink jet recording apparatus has come to be available.

In a cartridge type ink jet recording apparatus of this kind, a recording medium is mounted on a cartridge that is totally made of a hard resin material, and the amount of remaining ink or the like is recorded on the recording medium. The recording medium mounted on the cartridge has a metal contact which physically makes contact with a metal connector of the ink jet recording apparatus after the cartridge is attached to a reservoir of the ink jet recording apparatus so that the recording medium is electrically connected to the ink jet recording apparatus.

In a cartridge type ink jet recording apparatus, when shock or external force is applied to a cartridge, a contact failure may occur at a contact point between a metal contact of a recording medium in the cartridge and a metal connector of the ink jet recording apparatus. More specifically, the cartridge includes an ink bottle and a rigid case which is made of a hard material and covers the entire ink bottle, and the recording medium is fixed to the rigid case. Therefore, external force or shock applied to the rigid case is directly transmitted to the metal contact of the recording medium, which may cause a contact failure in the contact point.

In particular, in an ink jet recording apparatus that employs a cartridge system, the cartridge is frequently inserted and removed. Therefore, a contact failure is likely to occur therein. For example, when a user grasps the rigid case and inserts the cartridge into the ink jet recording apparatus, an excessive force may be applied in a direction generally perpendicular to the insertion direction and the applied force may be directly transmitted to the metal contact of the recording medium, which may disadvantageously cause a contact failure in the contact point.

SUMMARY OF THE INVENTION

An object of the present invention is to provide an ink jet recording apparatus capable of suppressing the occurrence of a contact failure between a cartridge equipped with a recording medium and the ink jet recording apparatus, an ink or solvent cartridge, and a bottle included in the cartridge.

According to one embodiment of the present invention, the above technical object is achieved by providing a cartridge for an ink jet recording apparatus, the cartridge being detachably received in a cartridge receiving unit of a continuous type ink jet recording apparatus so as to replenish the ink jet recording apparatus with an ink or solvent, the cartridge including:

a body portion having an internal space storing an ink or solvent therein, the body portion at least partially having flexibility;

a rigid portion having a fluid path inside thereof, the fluid path communicating with the internal space of the body portion, the rigid portion having a smaller diameter and higher rigidity than the body portion; and a recording medium unit having a recording medium capable of recording information about the cartridge, wherein the recording medium unit is disposed on the rigid portion.

In the present invention, a configuration in which the recording medium unit is configured as a separate member and the recording medium unit is freely movably assembled to the rigid portion may be employed as an embodiment. Further, a configuration in which the recording medium unit is directly attached to the rigid portion may also be employed as another embodiment. External force or shock applied to the cartridge can be absorbed by the body portion which partially has flexibility. Therefore, even when the recording medium unit is directly attached to the rigid portion, it is possible to suppress the occurrence of a contact failure between the recording medium unit and the ink jet recording apparatus.

Therefore, in the cartridge of the present invention, even when shock or external force is applied to the cartridge, it is possible to suppress the applied force from being directly transmitted to the recording medium unit. The cartridge is preferably positioned by the cartridge receiving unit (corresponding to the reservoir of the embodiment) which receives the cartridge. Accordingly, it is possible to further suppress the occurrence of a contact failure in the contact which electrically connects the recording medium of the cartridge and the ink jet recording apparatus.

According to another embodiment of the present invention, the above technical object is achieved by providing a bottle detachably received in a reservoir of a continuous type ink jet recording apparatus so as to replenish the ink jet recording apparatus with an ink or solvent, the bottle including:

a bottle body having an internal space storing an ink or solvent therein, the bottle body at least partially having flexibility; and a mouth for discharging the ink or solvent inside the bottle body to the outside, the mouth projecting from the bottle body, wherein the mouth has higher rigidity than the bottle body, the mouth has an attachment portion to which a recoding medium unit having a recording medium capable of recording information about the bottle is attached, and the bottle is received in the reservoir with the recording medium unit attached to the attachment portion.

According to still another embodiment of the present invention, the above technical object is achieved by providing an ink jet recording apparatus including:

a head, the head including a nozzle from which ink droplets jet, a charging electrode for charging the ink droplets jetted from the nozzle, a deflection electrode for deflecting the ink droplets charged by the charging electrode, and a gutter for collecting ink droplets that are not deflected by the deflection electrode; and a body, the body including a main tank storing therein an ink liquid to be supplied to the head, a cartridge for replenishing the main tank with an ink or solvent, the cartridge having a cartridge body storing therein an ink liquid or a solvent and at least partially having flexibility, and an attachment portion having a fluid path inside thereof, the fluid path communicating with an internal space of the cartridge body, the attachment portion to which a recording medium unit having a recording medium that records information about the cartridge is attached, and a cartridge receiving unit detachably receiving the cartridge, wherein the attachment portion has a smaller diameter and higher rigidity than the cartridge body, the cartridge is received in the cartridge receiving unit with the recording medium unit attached to the attachment portion, the cartridge receiving unit includes an ink side cartridge receiving unit receiving an ink cartridge storing the ink therein and a solvent side cartridge receiving unit receiving a solvent cartridge storing the solvent therein, the solvent side cartridge receiving unit includes a misinsertion prevention mechanism for rejecting reception of the ink cartridge, and the ink side cartridge receiving unit allows the ink cartridge or the solvent cartridge to be attached thereto.

In the ink jet recording apparatus of the present invention, it is possible to suppress the occurrence of a contact failure between the cartridge provided with the recording medium and the ink jet recording apparatus and also possible to prevent trouble of misinsertion of the ink cartridge into the solvent side reservoir. Further, not only the ink cartridge, but also the solvent cartridge can be inserted into the ink side reservoir. Therefore, it is possible to clean the ink supply system using the solvent cartridge.

The effects and other objects of the present invention will become apparent from the following detailed description of the preferred embodiment of the present invention.

DETAILED DESCRIPTION OF PREFERRED EMBODIMENT

Embodiment

Hereinbelow, a preferred embodiment of the present invention will be described with reference to the accompanying drawings.

Figure 1:
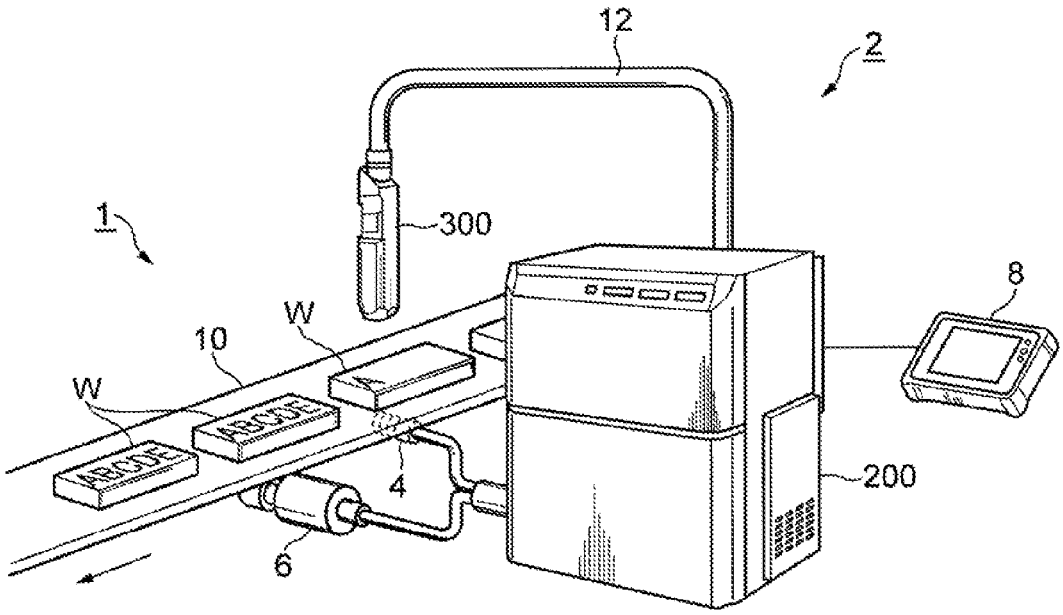
FIG. 1 is a diagram illustrating the entire configuration of an automatic printing system which includes a cartridge type ink jet printer of an embodiment.

Automatic Printing System and Ink Jet Printer:

FIG. 1 is a diagram illustrating the outline of an example of an automatic printing system which includes an ink jet recording apparatus. The illustrated automatic printing system 1 includes an ink jet recording apparatus 2 of the embodiment, a workpiece detection sensor 4, a conveyance speed sensor 6, a display device 8, and the like.

The ink jet recording apparatus 2 is generally called "ink jet printer". Therefore, the ink jet recording apparatus 2 will be described using the term "ink jet printer". The ink jet printer 2 is a continuous type printer which continuously jets ink. The ink jet printer 2 of the embodiment is installed in a workpiece conveyance line 10 and used for printing characters or graphics on a workpiece W flowing on the workpiece conveyance line 10. The workpiece W as a printing target is, for example, an electronic component, a plastic bag, or the like. The workpiece detection sensor 4 detects the presence/absence of the workpiece W and outputs a trigger for starting printing. Upon receiving the trigger signal, printing on the workpiece W is started.

The ink jet printer 2 includes a printer body 200 which is installed near the workpiece conveyance line 10 and a head 300 which is placed above the workpiece conveyance line 10. The printer body 200 and the head 300 are connected to each other through a flexible hose 12. A quick-drying ink liquid is circulated between the printer body 200 and the head 300. The head 300 performs dot printing on workpieces W which are conveyed one after another. An arrow in FIG. 1 indicates a conveyance direction of the workpiece W. FIG. 1 schematically illustrates the printer body 200. As for a detailed appearance configuration of the printer body 200, refer to FIGS. 3 to 5 and the like.

Figure 2:
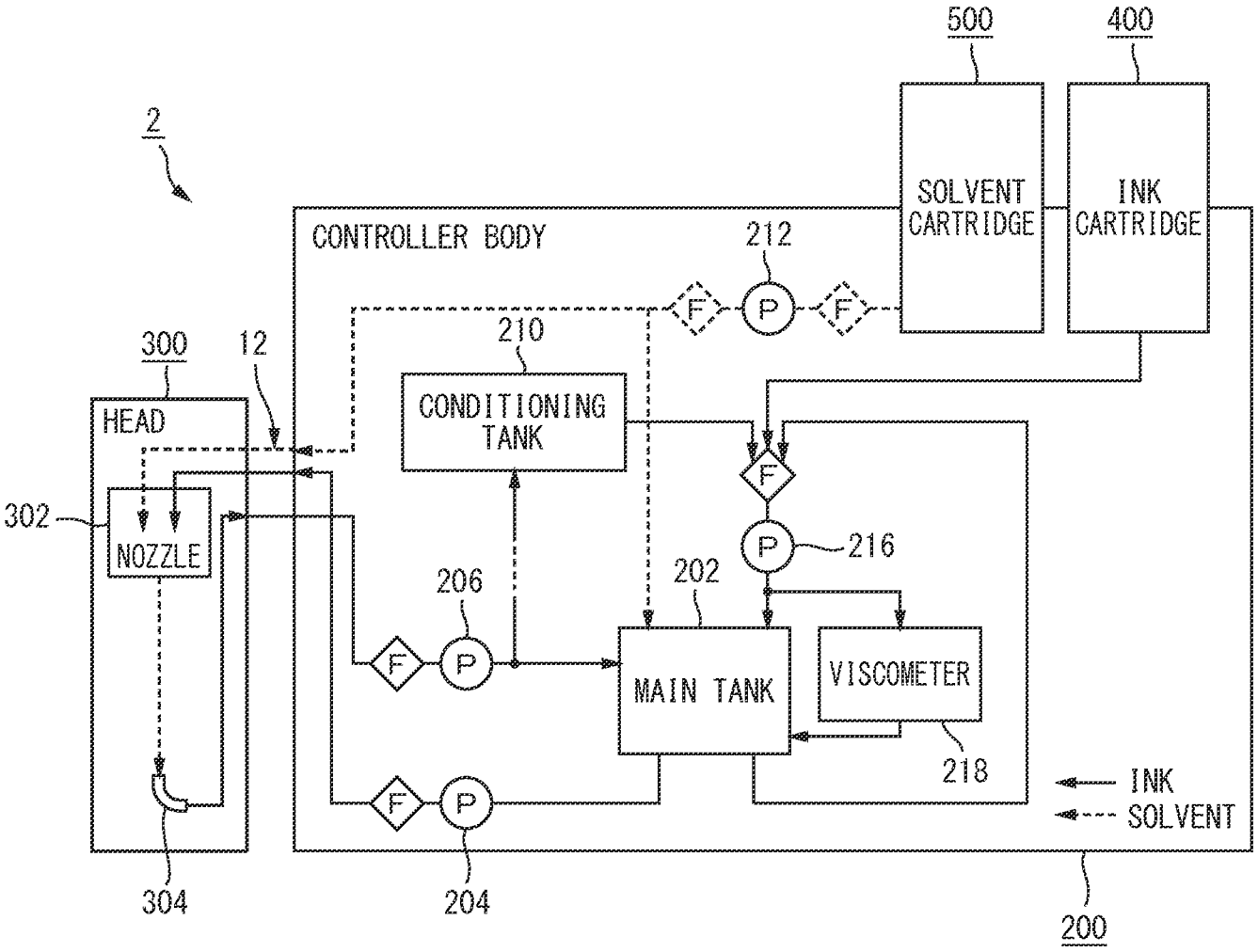
FIG. 2 is a diagram illustrating the entire configuration of a printer body which is a principal element of the ink jet printer.

FIG. 2 is a block diagram illustrating the outline of the entire configuration of the ink jet printer 2. The outline of the ink jet printer 2 will be described with reference to FIG. 2. The printer body 200 has a main tank 202 which is disposed inside thereof. An ink liquid is stored in the main tank 202. The quick-drying ink liquid inside the main tank 202 is supplied to a nozzle 302 of the head 300 by a first pump (ink supply pump) 204. The ink liquid is always and continuously supplied to the nozzle 302. Ink droplets that are ejected from the nozzle 302, but not used for printing on the workpiece W are received by a gutter 304. The ink droplets dropped onto the gutter 304 are sucked by a gutter pump 206 and then collected into the main tank 202. That is, the ink liquid ejected from the nozzle 302 is collected by the gutter 304 during when printing is suspended (during when ink droplets are not printed on a workpiece). In FIG. 2, F denotes a filter.

In other words, the printer body 200 and the head 300 constitute an ink circulation system. The quick-drying ink liquid is supplied to the nozzle 302 from the main tank 202. The ink liquid that is ejected from the nozzle 302 during when printing is suspended is collected into the main tank 202 through the gutter 304.

The ink jet printer 2 is a cartridge type printer. An ink cartridge 400 and a solvent cartridge 500 are detachably attached to the printer body 200. The ink liquid to be supplied to the main tank 202 is stored in the ink cartridge 400. A solvent for maintaining the viscosity of the ink liquid constant, for example, methyl ethyl ketone (MEK) is stored in the solvent cartridge 500.

In the ink jet printer 2, a cleaning treatment for cleaning the inside of the nozzle 302 of the head 300 is performed when starting or stopping the ink circulation system. When cleaning the nozzle 302, the solvent inside the solvent cartridge 500 is directly supplied to the nozzle 302 of the head 300 by a solvent pump 212. Then, the solvent ejected from the nozzle 302 is received in the gutter 304. The solvent received in the gutter 304 is sucked by the gutter pump 206, and sent to a conditioning tank 210. The solvent inside the conditioning tank 210 is supplied to the main tank 202 as needed by a replenishment/circulation pump 216, thereby reusing the collected solvent. As a modification, the conditioning tank 210 may be omitted and the solvent received in the gutter 304 may be sent to the main tank 202.

The replenishment/circulation pump 216 also has a function of sending out a replenishment ink liquid inside the ink cartridge 400 to the main tank 202 as needed and circulating the ink inside the main tank 202. That is, the replenishment/circulation pump 216 has a function as a circulation pump. Therefore, the ink liquid inside the main tank 202 is always circulated by the replenishment/circulation pump 216. A viscometer 218 is attached to the main tank 202. The viscometer 218 detects the viscosity of the ink liquid inside the main tank 202, and a solvent is supplied to the main tank 202 from the conditioning tank 210 based on the viscosity detected by the viscometer 218. As a result, the viscosity of the ink liquid inside the main tank 202 is maintained constant. When the conditioning tank 210 is empty, a solvent is supplied to the main tank 202 from the solvent cartridge 500.

There are several methods for detecting the amount of ink remaining in the ink cartridge 400 (or solvent remaining in the solvent cartridge 500). For example, when the amount of ink taken out of the ink cartridge 400 per unit time is known, it is possible to calculate the amount of ink taken out of the ink cartridge 400 by measuring driving time of the ink supply pump 204 (it is also possible to calculate the amount of remaining ink by subtracting the amount of taken-out ink from an initial ink amount). Alternatively, when the amount of ink taken out of the ink cartridge 400 per one operation (100 cc, for example) is known, for example, a liquid level gauge is provided inside the main tank 202 and the number of times of increase in the amount of ink inside the main tank 202 is measured using the liquid level gauge to thereby calculate the number of times of taking out of ink from the ink cartridge 400. Then, it is possible to calculate the amount of ink taken out of the ink cartridge 400 by multiplying the amount of taken-out ink per one operation by the number of times of taking out.

Also, there are several methods for detecting the emptiness of the cartridge. For example, when an increase in the amount of ink inside the main tank 202 is not detected by the liquid level gauge even when driving the ink supply pump 204 for a predetermined time (when time-out occurs), it is possible to detect that the ink cartridge 400 has become empty. On the other hand, it is not possible to detect the emptiness of the solvent cartridge 500 using the same liquid level gauge as used in the ink cartridge 400 (because the solvent is not only supplied to the main tank 202, but also used for cleaning the head 300). Therefore, emptiness detection can be performed, for example, by providing a reflective photoelectric sensor that includes a light emitter and a light receiver in the middle of a solvent path to which the solvent cartridge 500 is connected. Specifically, the photoelectric sensor is disposed so that the solvent path is located within a sensing area to which inspection light from the light emitter is applied. As a result, the amount of light received by the light receiver changes between when the solvent is present inside the solvent path and when air is present inside the solvent path. Therefore, for example, when it is determined that no solvent exists in the solvent path even when driving the solvent pump 212 for a predetermined time, it is possible to detect that the solvent cartridge 500 has become empty.

The configuration of the head 300 will be simply described. The head 300 is provided with a nozzle which jets ink, a charging electrode which charges the ink droplets jetted from the nozzle, a deflection electrode which deflects the charged ink droplets, and a gutter which is disposed to face the nozzle and collects ink droplets that are not used for printing.

JP 2007-190724 A describes, in detail, circulation of the ink liquid between the printer body 200 and the head 300, replenishment of the solvent to the main tank 202, that is, adjustment of the viscosity of the ink liquid inside the main tank 202, circulation of the ink liquid inside the main tank 202, a detailed configuration of the head 300, and details of a circuit of the printer body 200. Therefore, more detailed description will be omitted by incorporating the description of JP 2007-190724 A in the present specification. In the cartridge type ink jet printer 2, an ink supply system is cleaned using the solvent cartridge 500, for example, in long-term storage or transportation.

Figure 3:
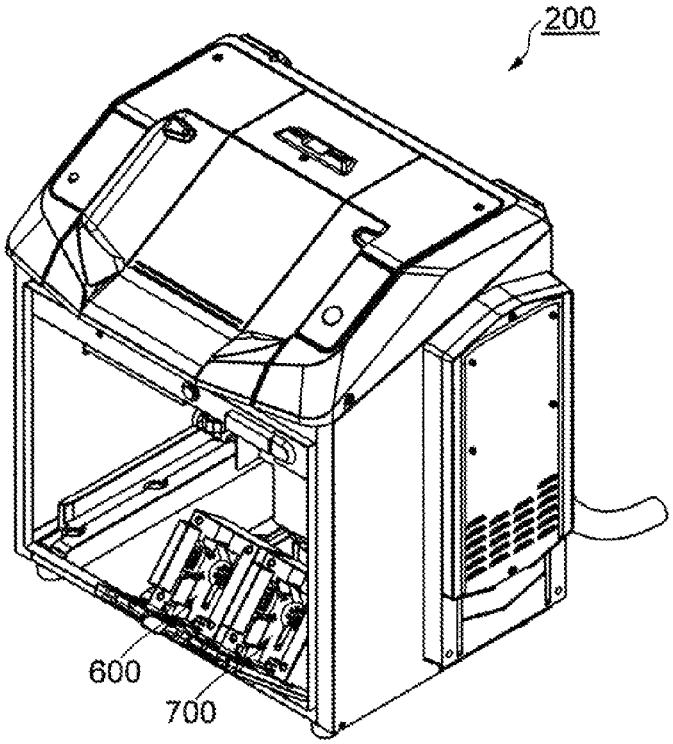
FIG. 3 is a diagram illustrating the printer body with a front door detached therefrom for explaining a state in which reservoirs are empty before attaching an ink cartridge and a solvent cartridge thereto.
Figure 4:
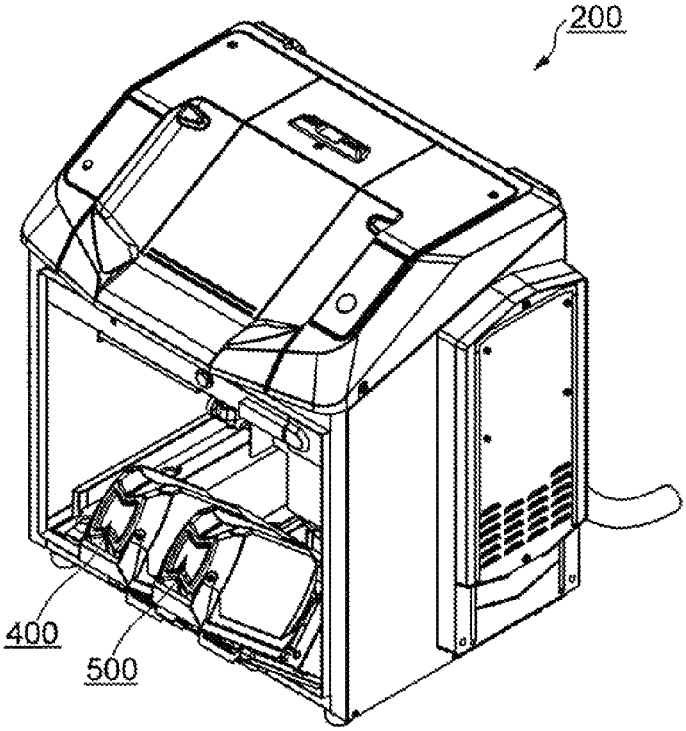
FIG. 4 is a diagram illustrating the printer body with the front door detached therefrom for explaining a state in which the ink cartridge and the solvent cartridge are inserted into the respective reservoirs.
Figure 5:
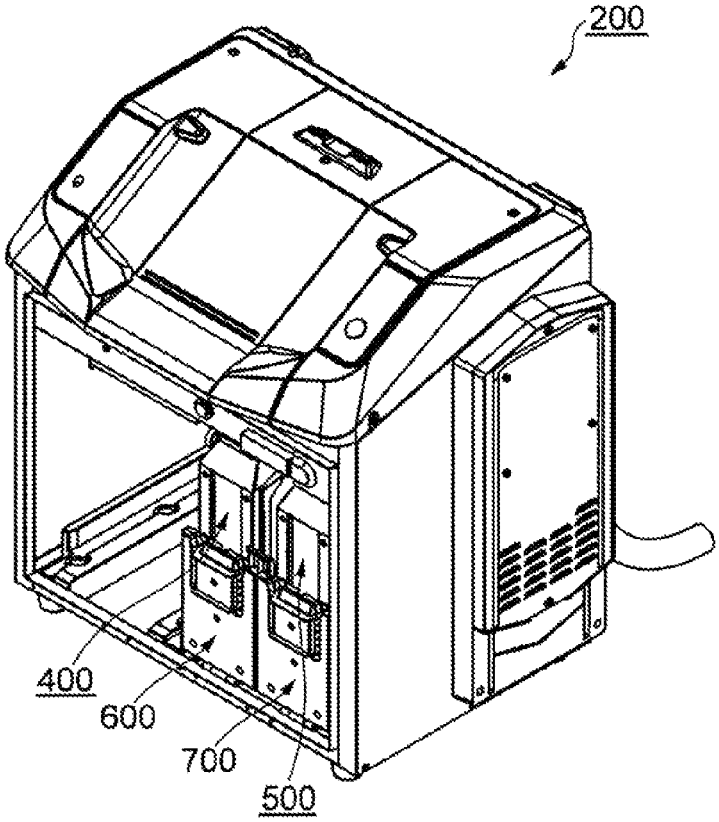
FIG. 5 is a diagram illustrating the printer body with the front door detached therefrom for explaining a state in which attachment of the ink cartridge and the solvent cartridge to the respective reservoirs has been completed.

Ink Cartridge, Solvent Cartridge:

FIGS. 3 to 5 illustrate the printer body 200 with a front door detached therefrom. FIG. 3 illustrates a state in which the ink cartridge 400 and the solvent cartridge 500 are detached. Referring to FIG. 3, the printer body 200 includes an ink side reservoir 600 which receives the ink cartridge 400 and a solvent side reservoir 700 which receives the solvent cartridge 500. When the ink cartridge 400 and the solvent cartridge 500 are detached, the ink side reservoir 600 and the solvent side reservoir 700 can take an inclined attitude. In other words, the ink side reservoir 600 and the solvent side reservoir 700 can take two attitudes, specifically, a vertically standing state (refer to FIG. 5 described later) and a state inclined by a predetermined angle toward the outside of the printer body 200 from the vertical direction (refer to FIG. 4) by swing. When each of the reservoirs is configured to be transitionable to the latter state, the attachment/detachment of the cartridge can be simplified. FIG. 4 illustrates a state in which the cartridge 400 is inserted into and thereby attached to the ink side reservoir 600 and the solvent cartridge 500 is inserted into and thereby attached to the solvent side reservoir 700. FIG. 5 illustrates a state in which the ink cartridge 400 and the solvent cartridge 500 are housed in the printer body 200 by returning the ink side reservoir 600 and the solvent side reservoir 700 to a vertically standing state.

The ink side reservoir 600 and the solvent side reservoir 700 are arranged on the lower right part of the inside of the printer body 200. In FIGS. 3 to 5, there is an empty space in the lower left part of the inside of the printer body 200. However, pump modules (not illustrated) including the ink supply pump 204, the gutter pump 206, the replenishment/circulation pump 216 and the like are arranged in this space. That is, when viewing the printer body 200 from the front side thereof, in the lower part of the inside of the printer body 200, the pump modules are arranged on at least one of right and left sides, and the ink side reservoir 600 and the solvent side reservoir 700 are arranged side by side on the other side. The positional relationship between the ink side reservoir 600 and the solvent side reservoir 700 may be reversed.

FIGS. 6 to 11 illustrate a bottle 800 which is used as a principal part of each of the ink cartridge 400 and the solvent cartridge 500. The bottle 800 serves as a container for storing the ink in the ink cartridge 400 and serves as a container for storing the solvent in the solvent cartridge 500.

Figure 6:
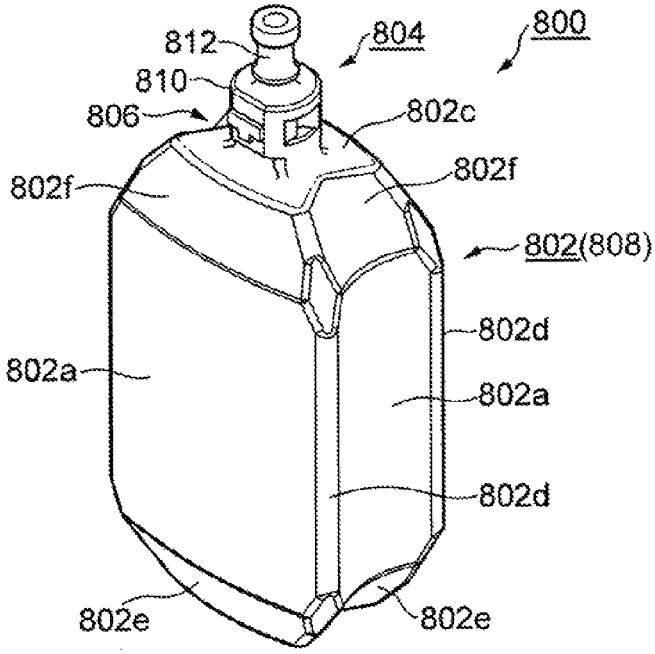
FIG. 6 is a perspective view of a bottle which is a principal element of each of the ink cartridge and the solvent cartridge.
Figure 7:
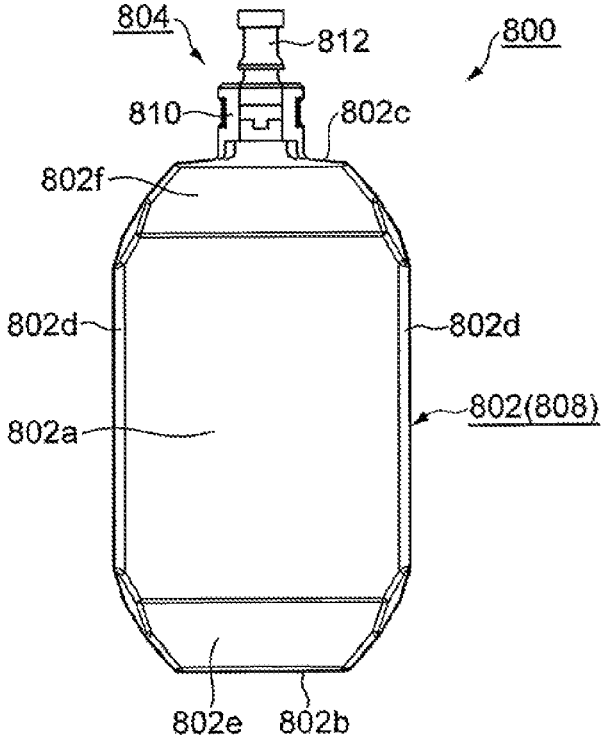
FIG. 7 is a front view of the bottle illustrated in FIG. 6.
Figure 8:
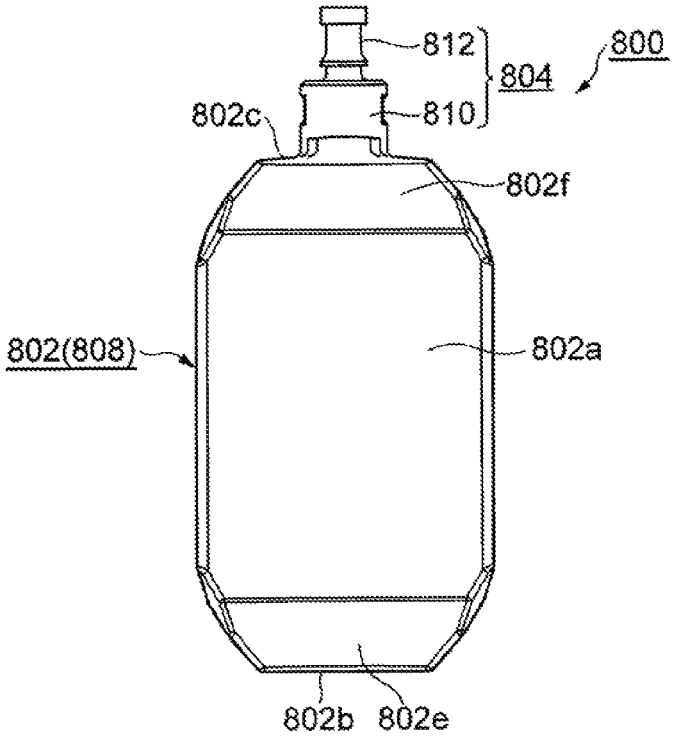
FIG. 8 is a rear view of the bottle illustrated in FIG. 6.
Figure 9:
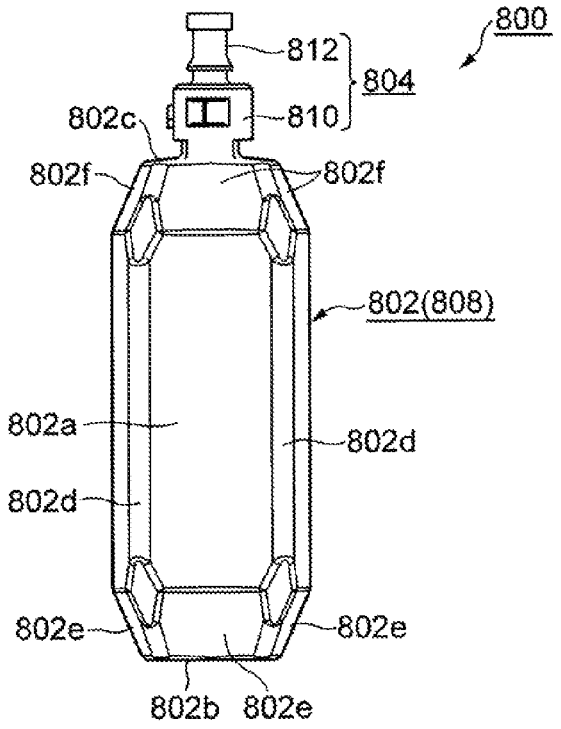
FIG. 9 is a right side view of the bottle illustrated in FIG. 6, wherein a left side view of the bottle is the same as the right side view.
Figure 10:
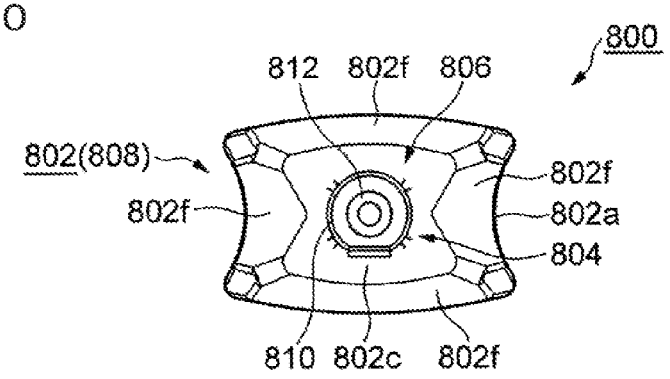
FIG. 10 is a plan view of the bottle illustrated in FIG. 6.
Figure 11:
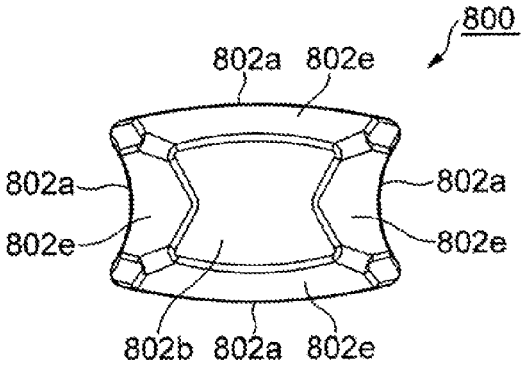
FIG. 11 is a bottom view of the bottle illustrated in FIG. 6.

Bottle:

FIG. 6 is a perspective view of the bottle 800. FIG. 7 is a front view of the bottle 800. FIG. 8 is a rear view of the bottle 800. FIG. 9 is a right side view of the bottle 800. A left side view of the bottle 800 is the same as the right side view of FIG. 9 and therefore omitted. FIG. 10 is a plan view of the bottle 800. FIG. 11 is a bottom view of the bottle 800.

Figure 12:
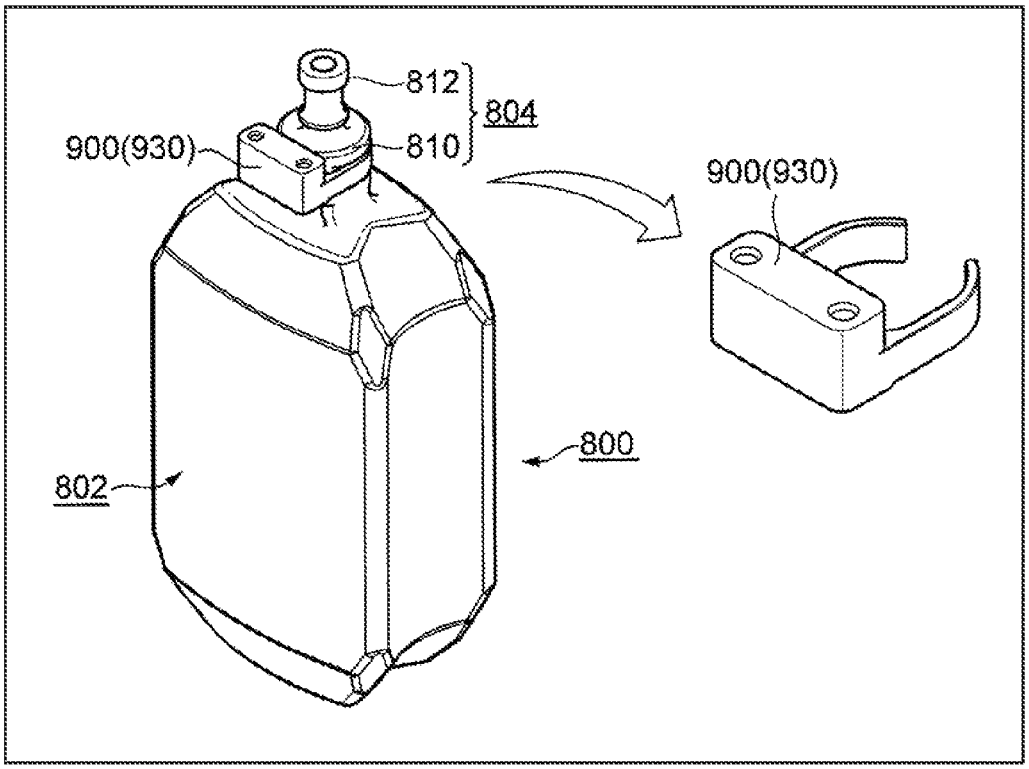
FIG. 12 is a diagram for explaining that a ROM unit is attached to a neck of the bottle illustrated in FIG. 6.
Figure 13:
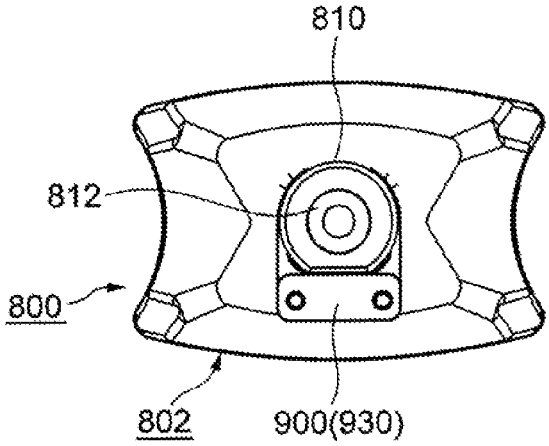
FIG. 13 is a plan view of the bottle with the ROM unit attached thereto.

As illustrated in FIGS. 12 and 13, a recording medium unit (ROM unit) 900 (930) is attached to the bottle 800 illustrated in FIGS. 6 to 11. FIG. 12 is a perspective view of the bottle 800 with the ROM unit 900 (930) attached thereto. FIG. 13 is a plan view of the bottle 800 with the ROM unit 900 (930) attached thereto.

Referring to FIGS. 6 to 11, the bottle 800 is a molded article made of a synthetic resin. The bottle 800 includes a bottomed bottle body 802 and a projecting portion 804 which projects in the axial direction from the central part of one end face of the bottle body 802. In the description for the bottle 800, the bottle 800 is in a standing state with the projecting portion 804 facing upward as illustrated. It is needless to say that the bottle 800 is attached to the printer body 200 with the projecting portion 804 facing downward, for example, by vertically inverting the state illustrated in FIG. 6.

The bottle body 802 has a generally rectangular parallelepiped shape. The bottle body 802 has four side faces 802*a*, a bottom face 802*b*, and a top face 802*c*. The projecting portion 804 is positioned on the central part of the top face 802*c*. The bottle body 802 further has four side corner portions 802*d* each having a shape chamfering a part between adjacent side faces 802*a*, 802*a*. Further, the bottom face 802*b* is connected to the lower end of each of the side faces 802*a* and the lower end of each of the side corner portions 802*d* with a bottom inclined face 802*e* interposed therebetween. Similarly, the top face 802*c* is connected to the upper end of each of the side faces 802*a* and the upper end of each of the side corner portions 802*d* with an upper inclined face 802*f* interposed therebetween.

When a liquid (ink or solvent) which is a content of the bottle 800 is sucked out of the bottle 800, the bottle 800 is crushed to reduce the volume thereof in response to the suction. In the embodiment, the central part of the top face 802*c* and the projecting portion 804 of the bottle 800 constitute a rigid portion 806 which is resistant to deformation. On the other hand, the bottle body 802 excepting the central part of the top face 802*c* is flexible. The flexible portion in the bottle body 802 constitutes a volume reduction portion 808 which deforms corresponding to a decrease of the liquid as the content so that the volume of the bottle body 802 decreases in response to the decrease of the content.

In the embodiment, the side faces 802*a* and the side corner portions 802*d* are thin. On the other hand, the upper inclined faces 802*f*, the bottom inclined faces 802*e*, and the bottom face 802*b* are relatively thick. As will be described later, when the bottle 800 is formed by blow molding, the thickness of the bottle 800 is gradually reduced toward the far side from an axis line passing through the center of the mouth 812 of the bottle 800. Therefore, the side corner portions 802*d* which are located farthest from the axis line are made thin. The bottle body 802 is designed so that the dimension in the height direction hardly varies and the volume thereof is reduced by a decrease in the dimension in the width direction by adjusting the thickness. That is, the bottle body 802 is designed so as to be made smaller in the width direction in a defined form by adjusting the thickness of the upper inclined faces 802*f* and the bottom inclined faces 802*e*. It is needless to say that the volume reduction portion 808 of the bottle body 802 may be made of an aluminum pouch or a thin flexible resin material and covered with a relatively hard outer cover which is composed of, for example, a synthetic resin molded article.

The projecting portion 804 which projects in the axial direction from a generally central part of the top face 802*c* of the bottle body 802 includes a neck 810 which expands after slightly extending upward from the bottle top face 802*c* and has a relatively large diameter and the mouth 812 which extends upward from the upper end of the neck 810 and has a relatively small diameter. A rubber stopper (not illustrated) is inserted into the mouth 812 after filling the bottle 800 with the content to thereby seal the bottle 800.

The bottle body 802 and the projecting portion 804 may be integrally molded, for example, by blow molding or hollow molding. For example, a pellet-shaped resin raw material is melted and formed into a pipe shape in a blow molding machine to form a parison. The parison is sandwiched between molds, and air is then blown into the parison so as to be swelled to thereby allow the parison to adhere to the inner faces of the molds. After obtaining a desired product shape, the parison is cooled to be hardened. Further, a burr is removed as needed. In this manner, the bottle 800 can be integrally molded.

Figure 14:
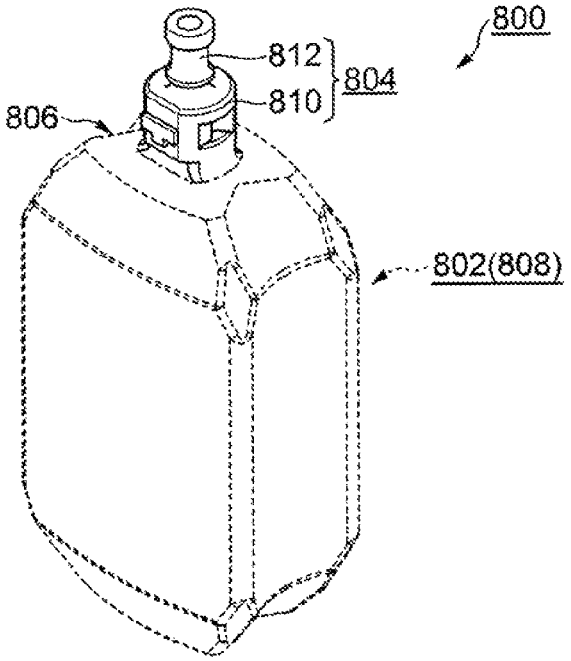
FIG. 14 is a perspective view of the bottle illustrated in FIG. 6, wherein the neck and a mouth of the bottle are indicated by solid lines and the other portions are indicated by broken lines.
Figure 15:
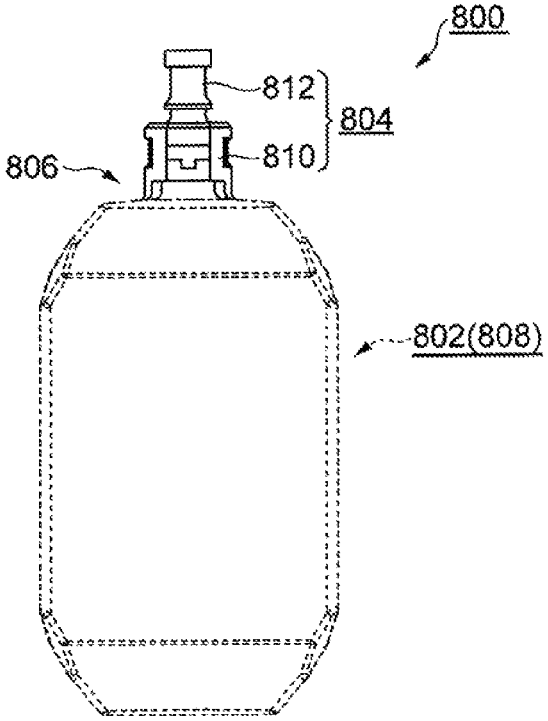
FIG. 15 is a front view of the bottle illustrated in FIG. 14.
Figure 16:
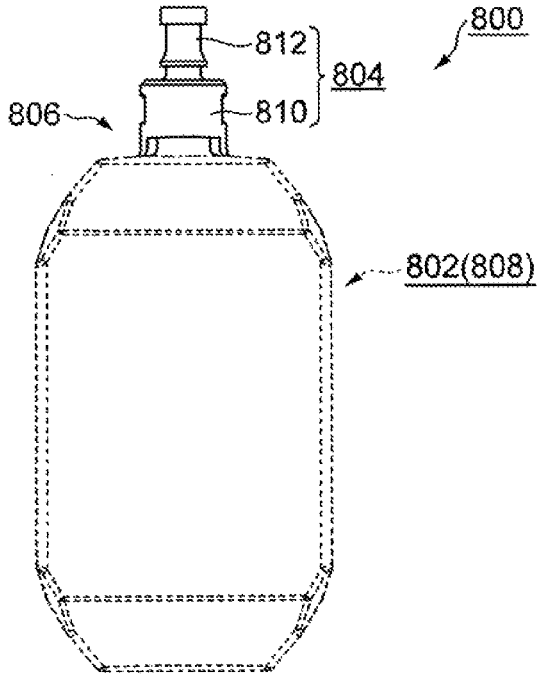
FIG. 16 is a rear view of the bottle illustrated in FIG. 14.
Figure 17:
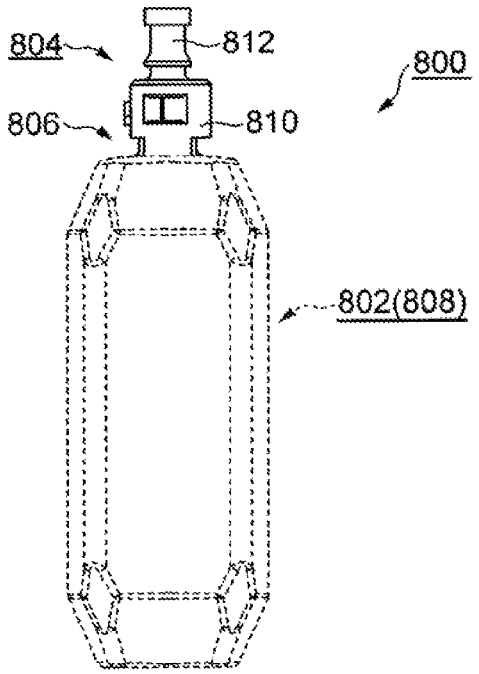
FIG. 17 is a right side view of the bottle illustrated in FIG. 14, wherein a left side view of the bottle is the same as the right side view.
Figure 18:
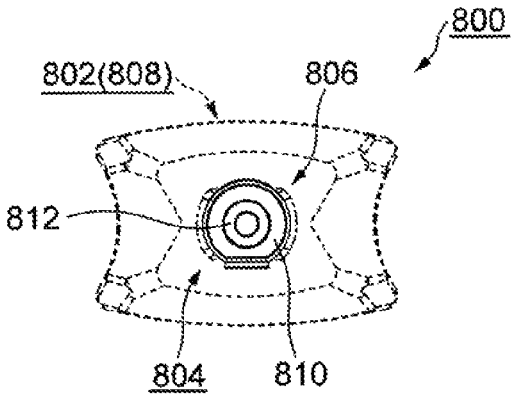
FIG. 18 is a plan view of the bottle illustrated in FIG. 14.
Figure 19:
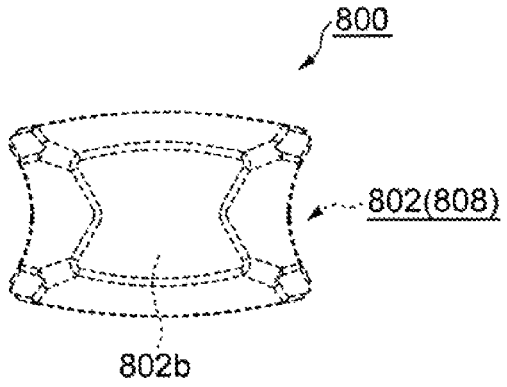
FIG. 19 is a bottom view of the bottle illustrated in FIG. 14.

FIGS. 14 to 19 respectively correspond to FIGS. 6 to 11 which illustrate the bottle 800. In FIGS. 14 to 19, the neck 810 and the mouth 812 of the bottle 800 are indicated by solid lines, and the other portions are indicated by broken lines. FIG. 14 is a perspective view of the bottle 800. FIG. 15 is a front view of the bottle 800. FIG. 16 is a rear view of the bottle 800. FIG. 17 is a right side view of the bottle 800. A left side view of the bottle 800 is the same as the right side view of FIG. 17 and therefore omitted. FIG. 18 is a plan view of the bottle 800. FIG. 19 is a bottom view of the bottle 800.

The portions other than the neck 810 and the mouth 812 indicated by solid lines in FIGS. 14 to 19 can have various shapes. For example, the bottle body 802 may have a generally tubular shape and may also have a generally triangular tubular shape. However, as illustrated in FIGS. 14 to 19, when the bottle body 802 has a generally rectangular parallelepiped shape, the side faces of the bottle body 802 are easily deformed (dented) when the ink or solvent inside the bottle 800 is sucked out by the pump. As a result, it is possible to efficiently suck out the ink or the solvent without largely increasing the negative pressure inside the bottle body 802.

Further, the four side faces 802*a* include a pair of wide (large area) side faces 802*a* and a pair of narrow (small area) side faces 802*a*. The pair of narrow side faces 802*a* has a concave shape (refer to the plan view of FIG. 10). In other words, as illustrated in FIG. 10, the pair of wide side faces 802*a* has a shape projecting toward the outer side of the bottle body 802. On the other hand, the pair of narrow side faces 802*a* has a shape projecting toward the inner side of the bottle body 802. Accordingly, when the ink or solvent inside the bottle 800 is sucked out by the pump, the pair of narrow side faces 802*a* is first easily deformed. The wide side faces 802*a* come closer to each other with the bottle body 802 maintaining a generally flat shape and the bottle body 802 is uniformly crushed. Therefore, it is possible to more efficiently suck out the ink or solvent without largely increasing the negative pressure inside the bottle body 802. That is, it is possible to efficiently suck out the ink or solvent with the smallest possible suction force.

After the pair of narrow side faces 802*a* is crushed, each of the portions of the volume reduction portion 808 including the side corner portions 802*d* is gradually deformed (with being twisted in some cases). In other words, the pair of narrow side faces 802*a* is relatively easily deformed compared to the pair of wide side faces 802*a*. Further, the pair of wide side faces 802*a* is relatively easily deformed compared to the side corner portions 802*d*.

Figure 20:
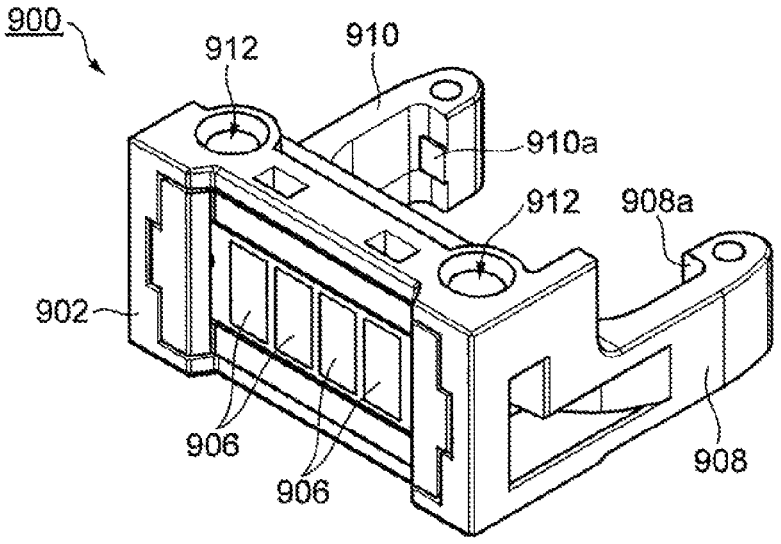
FIG. 20 is a perspective view of a solvent cartridge ROM unit.
Figure 21:
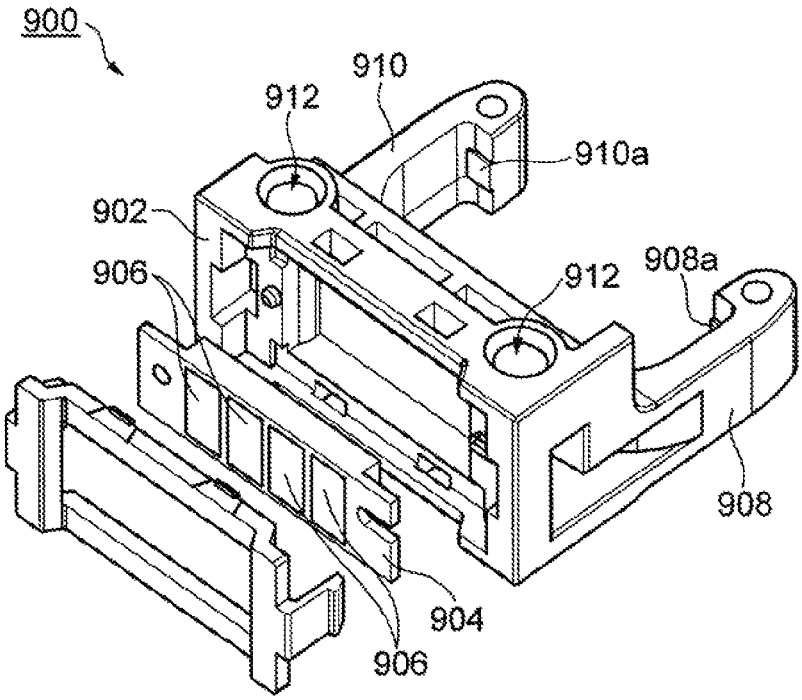
FIG. 21 is an exploded perspective view of the solvent cartridge ROM unit.

ROM Unit:

FIGS. 20 and 21 illustrate the recording medium unit, that is, the ROM unit 900 (930). FIG. 20 is a perspective view of the ROM unit 900 (930). FIG. 21 is an exploded perspective view of the ROM unit 900 (930). The ROM unit 900 (930) includes a ROM holder body 902 and a circuit board 904 housed in the ROM holder body 902. The circuit board 904 has four terminal contact surfaces 906 which are arranged side by side on one face thereof. On the other face (not illustrated in FIGS. 20 and 21 for drawing reasons) of the circuit board 904, an electrically erasable programmable read-only memory (EEPROM) which is a recording medium, that is, a nonvolatile memory is mounted. In the ROM (recording medium), there are recorded information such as a lot number specific to each cartridge, a maker identification number, a cartridge version, a manufacturer identification number, an ink or solvent type, a serial number, the date of manufacture (of ink or solvent) and also the capacity of the bottle 800 and the amount of ink or solvent remaining in the bottle 800.

An identification number specific to the ink cartridge 400 or the solvent cartridge 500 to which the ROM unit 900 (930) is attached may be recorded on the recording medium of the ROM unit 900 (930), and the amount of ink or solvent remaining in the ink cartridge 400 or the solvent cartridge 500 may be controlled in the printer body 200 on the basis of the recorded identification number.

The ROM holder body 902 has a generally rectangular parallelepiped shape. The circuit board 904 is housed in the ROM holder body 902. The ROM unit 900 (930) further has first and second arms 908, 910 which extend rearward from two longitudinal ends of the ROM holder body 902. The ROM unit 900 (930) is fixed to the rigid portion 806 of the bottle 800, specifically, to the neck 810 of the bottle 800 using the first and second arms 908, 910. That is, the ROM unit 900 (930) is fixed only to the side faces of the neck 810. The ROM unit 900 (930) may be relatively undisplaceably fixed to the rigid portion 806 of the bottle 800. However, in the embodiment, the ROM unit 900 (930) is relatively displaceably fixed to the rigid portion 806. That is, the ROM unit 900 (930) is relatively displaceable with respect to the bottle 800. On the other hand, the ROM holder body 902 is positioned relatively undisplaceably with respect to the printer body 200. In FIGS. 20 and 21, reference numeral 912 denotes a positioning hole. Although a single positioning hole 912 may be formed, a plurality of positioning holes are preferably formed. In the embodiment, one positioning hole 912 is formed on each side of a portion that houses the circuit board 904 in the ROM holder body 902. The function of the positioning hole 912 will be described later.

Figure 22:
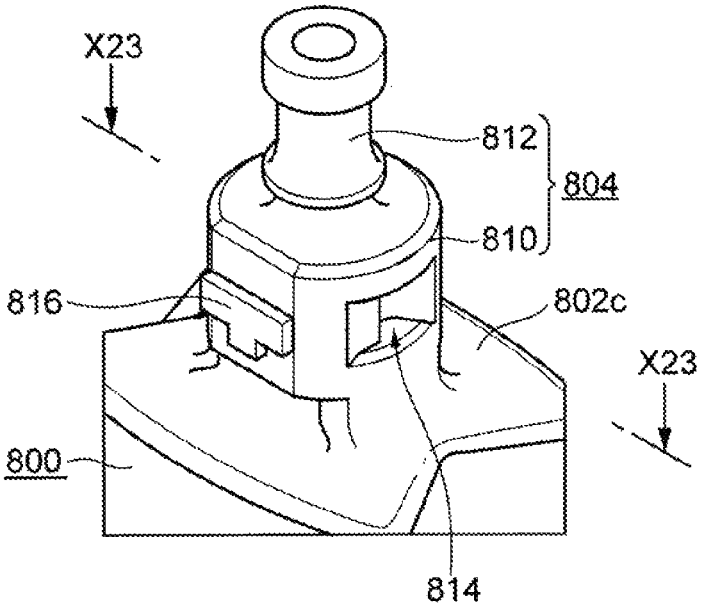
FIG. 22 is an enlarged view of the neck and the mouth of the bottle.
Figure 23:
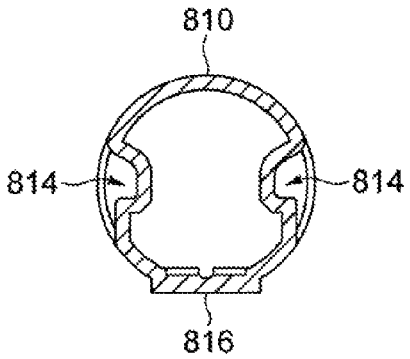
FIG. 23 is a cross-sectional view taken along line X23-X23 of FIG. 22.

FIGS. 22 to 25 are diagrams for explaining the relationship between the structure of the neck 810 of the bottle 800 and the ROM unit 900 (930) attached to the neck 810 of the bottle 800 (hereinbelow, also referred to as "bottle neck 810"). Referring to FIG. 22 and FIG. 23 which is a cross-sectional view taken along line X23-X23 of FIG. 22, the bottle neck 810 has two locking grooves 814 which are separated from each other in the circumferential direction. Further, the bottle neck 810 preferably has a positioning projection 816 which is formed to face the ROM holder body 902. The positioning projection 816 has a T shape when viewed from the front side. In other words, the positioning projection 816 has a shape that extends vertically and horizontally, that is, extends in directions perpendicular to each other (FIG. 22). The shape of the positioning projection 816 in a front view may be, for example, a circular shape. However, in order to restrict rotation of the ROM unit 900 (930), particularly, the ROM holder body 902 relative to the bottle neck 810, a non-circular shape may be selected. The positioning projection 816 may not necessarily be provided, and may therefore be omitted.

Figure 24:
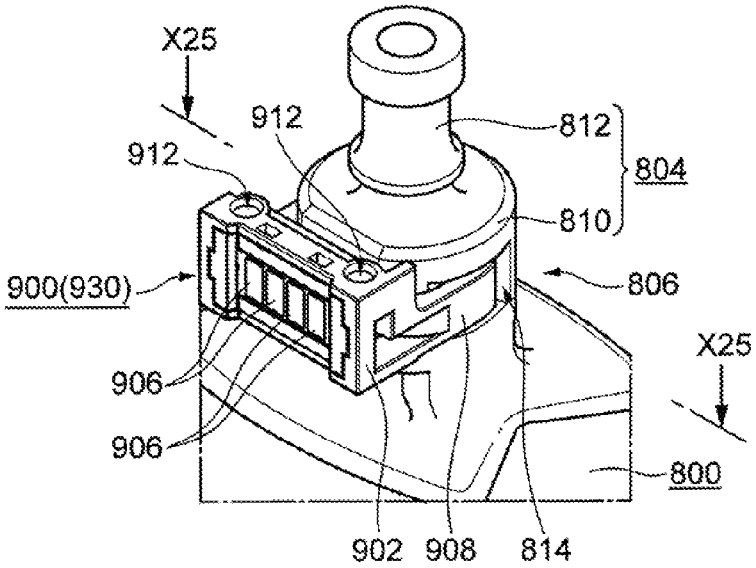
FIG. 24 is an enlarged view of the neck and the mouth of the bottle with the ROM unit attached thereto.
Figure 25:
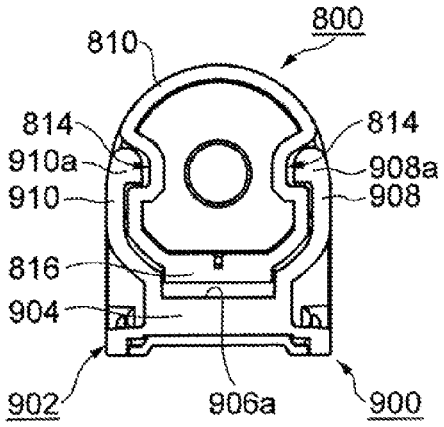
FIG. 25 is a cross-sectional view taken along line X25-X25 of FIG. 24.

Description will be made with reference to FIG. 24 and FIG. 25 which is a cross-sectional view taken along line X25-X25 of FIG. 24. FIGS. 24 and 25 illustrate a state in which the ROM unit 900 (930) is attached to the bottle neck 810. As best illustrated in FIG. 25, the first arm 908 and the second arm 910 of the ROM unit 900 (930) extend to face each other across the bottle neck 810 and each have a contour shape complementary to the outer shape of the bottle neck 810. A claw 908*a* formed on the tip of the first arm 908 and a claw 910*a* formed on the tip of the second arm 910 are detachably engaged with steps of the locking grooves 814 so that the ROM unit 900 (930) is positioned on the bottle neck 810 by the recess-projection engagement. When the claws 908*a*, 910*a* are engaged with the steps of the respective locking grooves 814, the T-shaped positioning projection 816 of the bottle neck 810 is received in a recess 906*a* which is formed on the inner surface of the ROM holder body 902. The recess 906*a* has a shape complementary to the T-shaped positioning projection 816. However, the T-shaped positioning projection 816 is loosely fitted with the recess 906*a*. That is, the ROM unit 900 (930) is fixed to the bottle neck 810 with a certain amount of play allowed. In the embodiment, the first and second arms 908, 910 have the same shape and the same dimension. However, the first and second arms 908, 910 may have any shape and any dimension.

The claws 908*a*, 910*a* and the steps of the locking grooves 814 are relatively related. Therefore, it is, of course, only required that projections (the claws 908*a*, 910*a*) be located on one member, and recesses (the steps of the locking grooves 814) be located on the other member in such recess-projection (boss) engagement.

Figure 26:
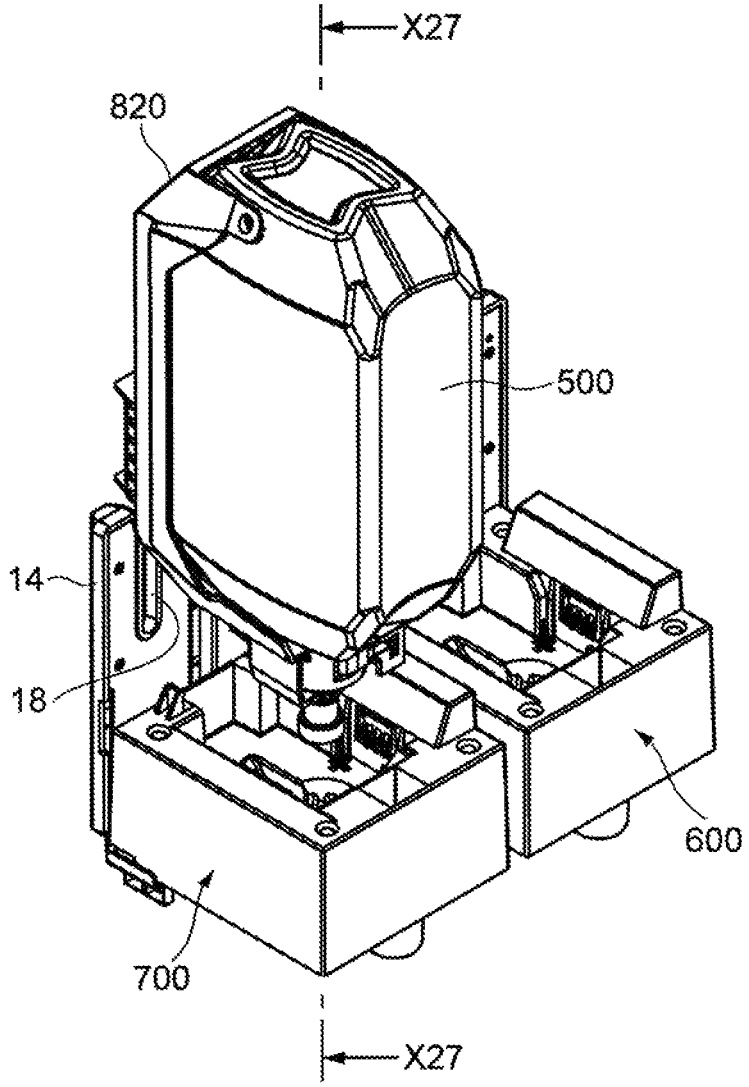
FIG. 26 is a perspective view of the reservoirs extracted from the ink jet printer for explaining the process of inserting a cartridge.
Figure 27:
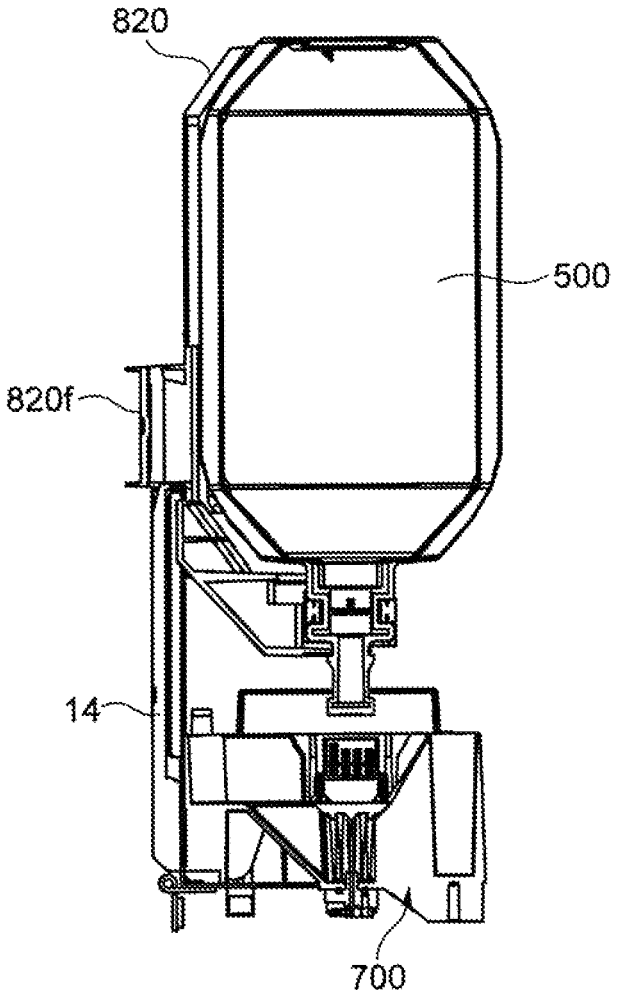
FIG. 27 is a cross-sectional view taken along line X27-X27 of FIG. 26.
Figure 28:
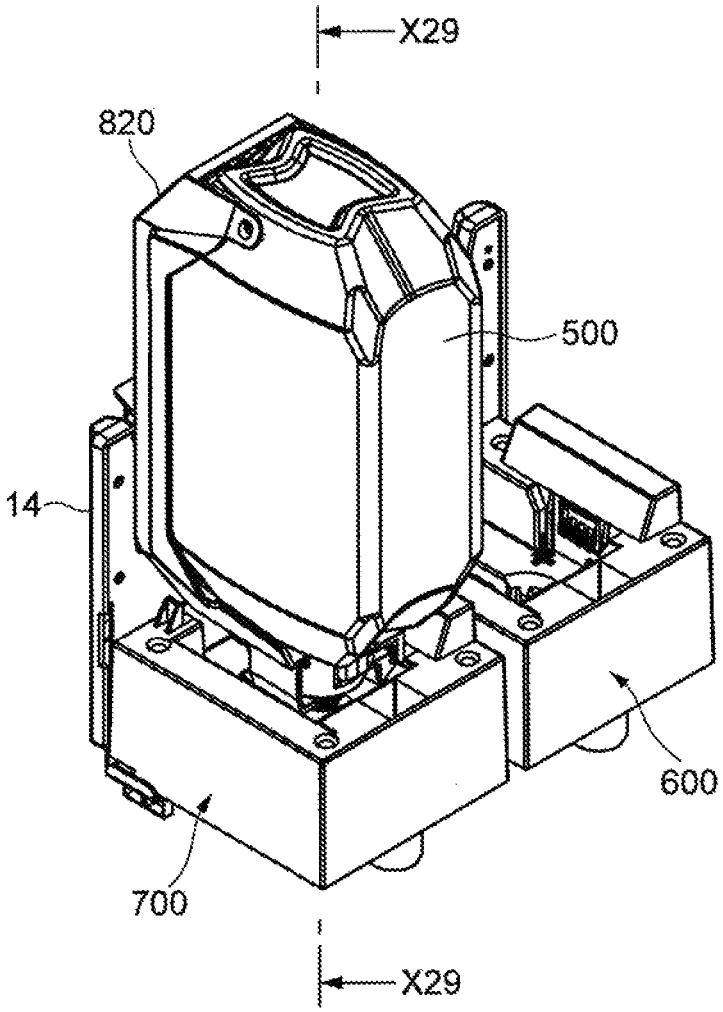
FIG. 28 is a perspective view of the reservoirs extracted from the ink jet printer for explaining a state in which attachment of the cartridge has been completed.
Figure 29:
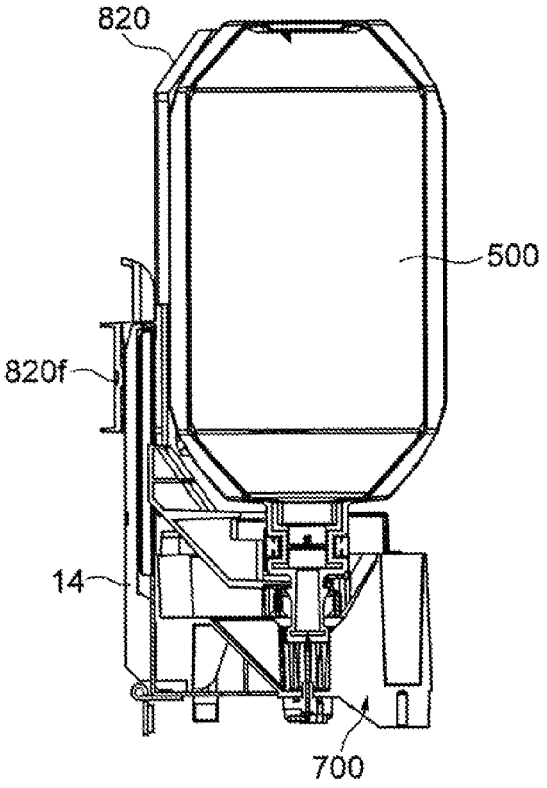
FIG. 29 is a cross-sectional view taken along line X29-X29 of FIG. 28.

Reservoir (Cartridge Receiving Unit):

FIGS. 26 to 29 are diagrams illustrating the ink side reservoir 600 and the solvent side reservoir 700 which constitute a cartridge receiving unit for receiving the bottle 800, the ink side reservoir 600 and the solvent side reservoir 700 being extracted from the printer body 200. FIG. 26 illustrates a state in the middle of inserting the solvent cartridge 500 into the solvent side reservoir 700. FIG. 27 is a cross-sectional view taken along line X27-X27 of FIG. 26. FIG. 28 illustrates a state in which insertion of the solvent cartridge 500 into the solvent side reservoir 700 has been completed. FIG. 29 is a cross-sectional view taken along line X29-X29 of FIG. 28.

The ink side reservoir 600 and the solvent side reservoir 700 as the cartridge receiving unit are fixed to a common rear face plate 14 side by side and can take an inclined state illustrated in FIGS. 3 and 4 and a vertically standing state illustrated in FIG. 5 by swing of the common rear face plate 14.

Figure 30:
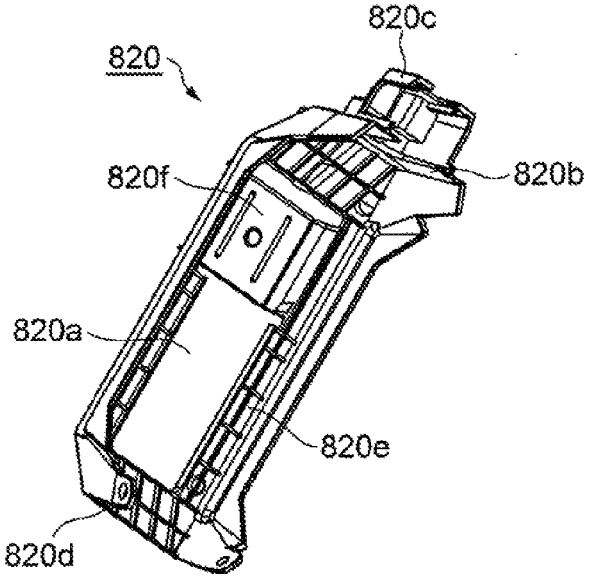
FIG. 30 is a perspective view of an attachment which constitutes part of the cartridge.

The bottle 800 has an attachment 820 which is located along one side face of the bottle 800. Referring to FIG. 30, the attachment 820 has a body 820*a* which has a shape extending straight along one side face of the bottle body 802. The attachment 820 has neck holders 820*b*, 820*c* which are formed on the upper end thereof and horizontally extend in two (upper and lower) stages. The lower neck holder 820*b* is engaged with a small diameter portion between the top face 802*c* and the bottle neck 810. The upper neck holder 820*c* is engaged with the upper end face of the bottle neck 810. That is, the bottle neck 810 is vertically sandwiched between the lower neck holder 820*b* and the upper neck holder 820*c*. Further, the attachment 820 has a lower support portion 820*d* which is formed on the lower end thereof and extends obliquely downward. The lower support portion 820*d* abuts on the bottom inclined face 802*e* of the bottle 800. By providing an engagement projection which is engaged with an engagement hole formed on the lower support portion 820*d* in the bottom inclined face 802*e* of the bottle 800, the attachment 820 is easily fixed to the bottle 800. As described above, the attachment 820 in the present embodiment mainly has a half-housing shape which covers one side face of the bottle 800. The side face on the other side of the bottle 800 is completely open. Therefore, for example, even when a surrounding environmental temperature increases and the pressure inside the bottle 800 thereby increases, which results in slight expansion of the bottle 800, the expansion of the bottle 800 is released by the open side face.

The attachment 820 is an integrally molded article made of a synthetic resin and has a plurality of reinforcing ribs 820*e* formed on the inner face thereof. The attachment body 820*a* has a bridge 820*f* which is formed on the upper end thereof, that is, in a region adjacent to the bottle neck 810. A role of the bridge 820*f* will be described later.

Figure 31:
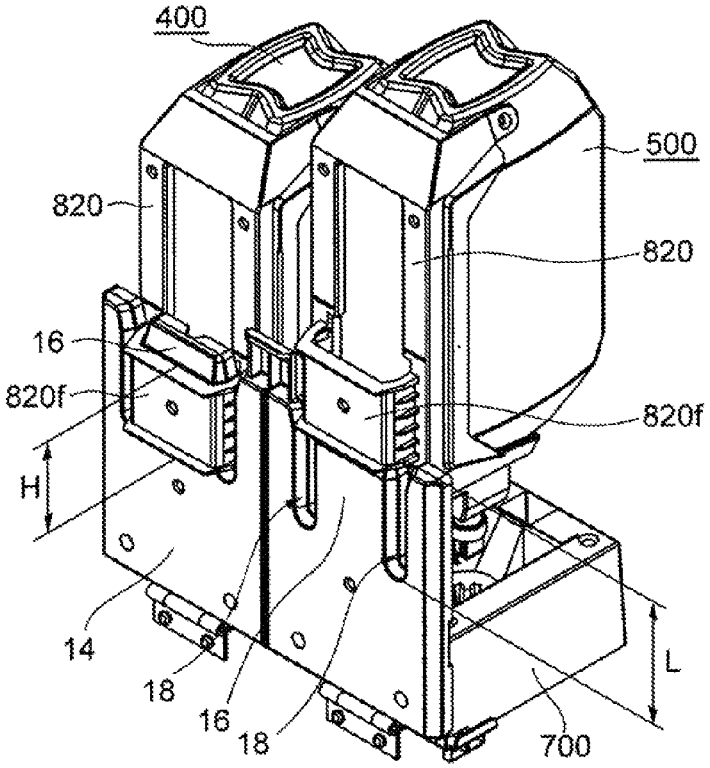
FIG. 31 is a rear view of the reservoirs.

FIG. 31 is a diagram illustrating the ink side reservoir 600 and the solvent side reservoir 700 viewed from the common rear face plate 14. The common rear face plate 14 has lips 16, 16 which are located corresponding to the ink side reservoir 600 and the solvent side reservoir 700. Each of the lips 16 is defined by slits 18 each vertically extending straight. Each of the slits 18 is open on the upper end of the common rear face plate 14.

FIG. 31 illustrates the process of inserting the solvent cartridge 500 into the solvent side reservoir 700, and, on the other hand, illustrates a state in which insertion of the ink cartridge 400 into the ink side reservoir 600 has been completed. For drawing reasons, the ink side reservoir 600 is not illustrated in FIG. 31. As can be seen from FIG. 31, in each of the cartridges 400, 500, the lip 16 is received in the bridge 820*f* of the attachment 820 and the insertion of each of the cartridges 400, 500 is guided by the lip 16. That is, the reservoirs 600, 700 are provided with the lips 16 which guide the insertion of the cartridges 400, 500, respectively, when receiving the cartridges 400, 500. When the cartridges 400, 500 with the attachment 820 attached thereto are inserted into the reservoirs 600, 700, respectively, the insertion of each of the cartridges 400, 500 is guided by the lips 16, thereby making it possible to insert each of the cartridges 400, 500 in substantially parallel to a hollow needle 612 which will be described later (refer to FIG. 35). In other words, the lips 16 formed on the common rear face plate 14 function as an example of a guide unit for preventing the cartridges 400, 500 from being obliquely inserted into the reservoirs 600, 700.

Figure 32:
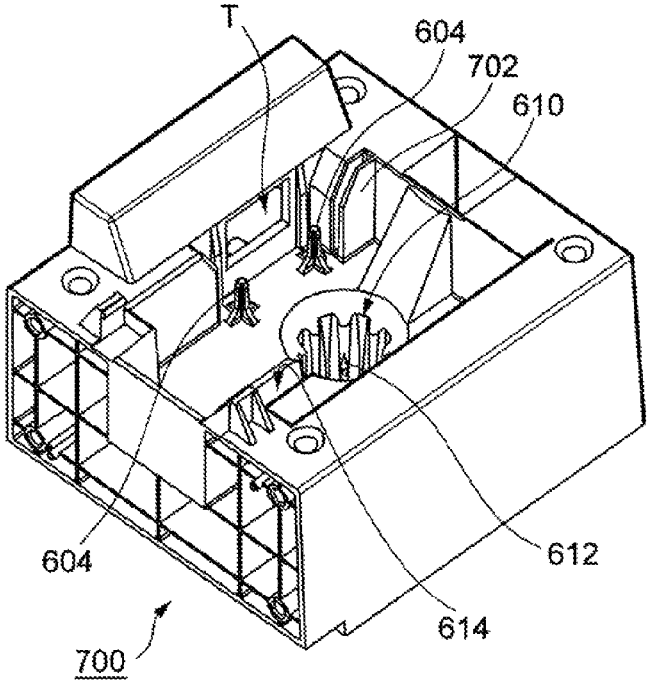
FIG. 32 is a perspective view of a solvent side reservoir.

The above-described ROM unit 900 illustrated in FIGS. 20 and 21 is used for the solvent cartridge 500. The solvent side reservoir 700 which receives the solvent cartridge 500 is illustrated in FIG. 32.

Figure 33:
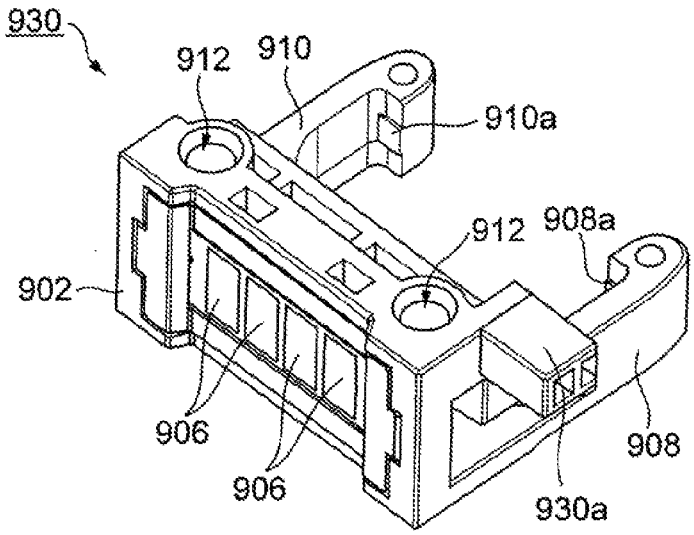
FIG. 33 is a perspective view of an ink cartridge ROM unit.
Figure 34:
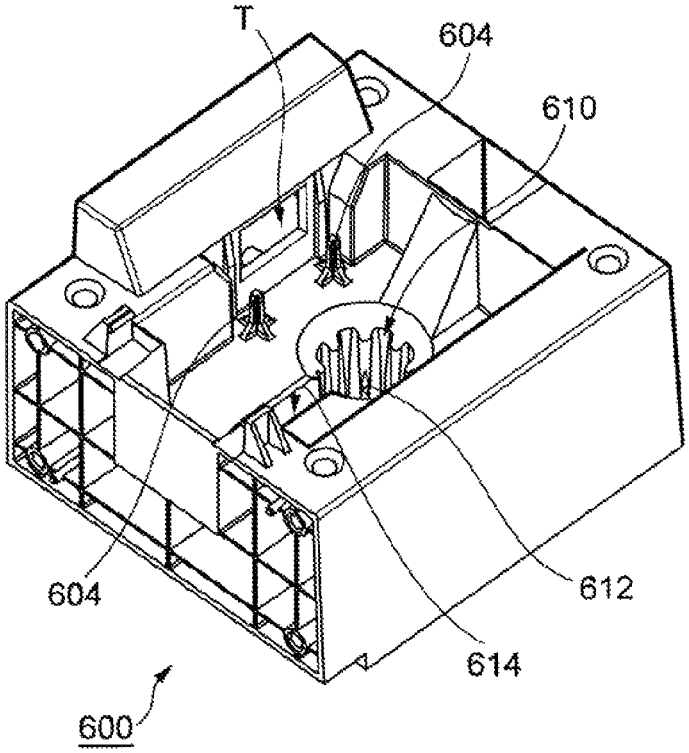
FIG. 34 is a perspective view of an ink side reservoir.

FIG. 33 illustrates the ROM unit 930 which is attached to the ink cartridge 400. FIG. 34 illustrates the ink side reservoir 600 which receives the ink cartridge 400. In the solvent side reservoir 700 illustrated in FIG. 32 and the ink side reservoir 600 illustrated in FIG. 34, terminals 602 (FIG. 35) which abut on the terminal contact surfaces 906 of the ROM units 900 and 930 are not illustrated. Alternatively, a region in which the terminals 602 are placed is represented by reference mark T.

As can be understood from the comparison between the solvent ROM unit 900 illustrated in FIGS. 20 and 21 and the ink ROM unit 930 illustrated in FIG. 33, the ink ROM unit 930 has an obstruction block 930*a* (FIG. 33) which laterally projects from the base end of the first arm 908, but, on the other hand, the obstruction block 930*a* is not provided in the solvent ROM unit 900 (FIGS. 20 and 21). The ink ROM unit 930 and the solvent ROM unit 900 have the same configuration excepting the presence or absence of the obstruction block 930*a*. As a modification, the obstruction block 930*a* may be provided in a rigid portion of the ink cartridge 400, for example, in the neck 810 of the bottle 800 which stores the ink therein.

Misinsertion Prevention Mechanism:

Referring to FIG. 32 illustrating the solvent side reservoir 700, the solvent side reservoir 700 has an obstruction rib 702. The obstruction rib 702 is not provided in the ink side reservoir 600 (refer to FIG. 34). The solvent side reservoir 700 (FIG. 32) and the ink side reservoir 600 (FIG. 34) have the same configuration excepting the presence or absence of the obstruction rib 702.

The attachment 820 and the ink ROM unit 930 are attached to the bottle 800 which stores an ink therein to thereby constitute the ink cartridge 400. The attachment 820 and the solvent ROM unit 900 are attached to the bottle 800 which stores a solvent therein to thereby constitute the solvent cartridge 500. The ink cartridge 400 and the solvent cartridge 500 are supplied to a user, and a user replaces the ink cartridge 400 and the solvent cartridge 500.

The obstruction block 930*a* provided in the ink ROM unit 930 or the ink cartridge 400 and the obstruction rib 702 provided in the solvent side reservoir 700 constitute a misinsertion prevention mechanism which prevents the ink cartridge 400 from being mistakenly attached to the solvent side reservoir 700. When the ink cartridge 400 is mistakenly attached to the solvent side reservoir 700, the ink flows in a solvent supply path and the flowing ink may be solidified in the middle of the solvent supply path, which may result in failure of the ink jet printer 2. Therefore, it is important to provide a mechanism for preventing such trouble.

For example, when the ink cartridge 400 is mistakenly inserted into the solvent side reservoir 700, the obstruction rib 702 (FIG. 32) of the solvent side reservoir 700 and the obstruction block 930*a* (FIG. 33) of the ink ROM unit 930 interfere each other so that the ink cartridge 400 cannot be inserted into the solvent side reservoir 700. That is, it is possible to prevent the ink cartridge 400 from being mistakenly attached to the solvent side reservoir 700 by the interference between the obstruction rib 702 and the obstruction block 930*a*. In FIG. 32, the obstruction rib 702 is a single plate-like rib. However, the present invention is not limited thereto. For example, a plurality of plate-like ribs may be arranged side by side. Accordingly, it is possible to more reliably allow the obstruction block 930*a* and the obstruction ribs 702 to interfere each other. As a result, it is possible to more reliably prevent misinsertion.

On the other hand, when the solvent cartridge 500 is intentionally inserted not into the solvent side reservoir 700, but into the ink side reservoir 600, the obstruction block 930*a* is not present in the solvent cartridge 500. Further, the obstruction rib 702 is not present in the ink side reservoir 600. Therefore, it is possible to insert the solvent cartridge 500 into the ink side reservoir 600. Accordingly, it is possible to clean the ink supply system with the solvent inside the solvent cartridge 500.

When the solvent cartridge 500 is inserted into the solvent side reservoir 700 for receiving the solvent cartridge 500, although the obstruction rib 702 is present in the solvent side reservoir 700, the obstruction block 930*a* is not present in the solvent cartridge 500. Therefore, it is possible to insert the solvent cartridge 500 into the solvent side reservoir 700.

Similarly, when the ink cartridge 400 is inserted into the ink side reservoir 600 for receiving the ink cartridge 400, although the obstruction block 930*a* is present in the ink cartridge 400, the obstruction rib 702 is not present in the ink side reservoir 600. Therefore, it is possible to insert the ink cartridge 400 into the ink side reservoir 600.

In summary, first, the insertion of the ink cartridge 400 into the solvent side reservoir 700 is prevented by the interference between the obstruction rib 702 of the solvent side reservoir 700 and the obstruction block 930*a* of the ink ROM unit 930. That is, the mechanism for preventing misinsertion of the ink cartridge 400 into the solvent side reservoir 700 effectively acts.

Second, it is possible to insert the solvent cartridge 500 into the ink side reservoir 600. Accordingly, it is possible to clean the ink supply system with the solvent inside the solvent cartridge 500.

Third, it is, of course, possible to insert the ink cartridge 400 into the ink side reservoir 600.

Fourth, it is, of course, possible to insert the solvent cartridge 500 into the solvent side reservoir 700.

Figure 35:
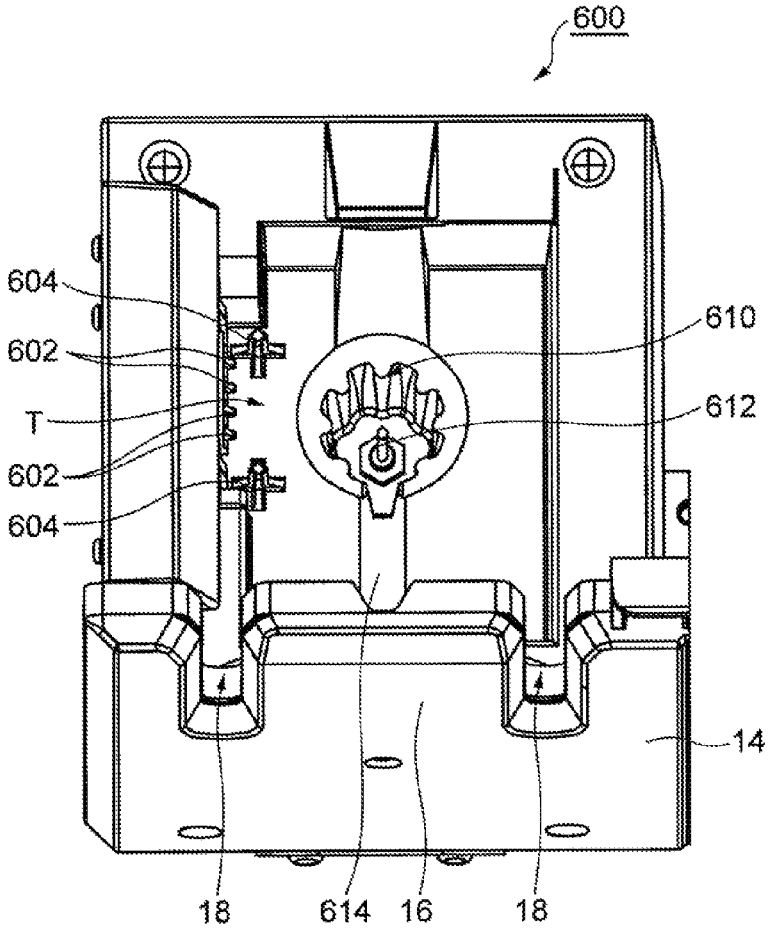
FIG. 35 is a perspective view of the ink side reservoir viewed from obliquely above.

FIG. 35 is a diagram for explaining the bottom part of the ink side reservoir 600. The structure of the bottom part of the ink side reservoir 600 is the same as the structure of the bottom part of the solvent side reservoir 700. Therefore, the following description can also be applied to the solvent side reservoir 700.

Figure 36:
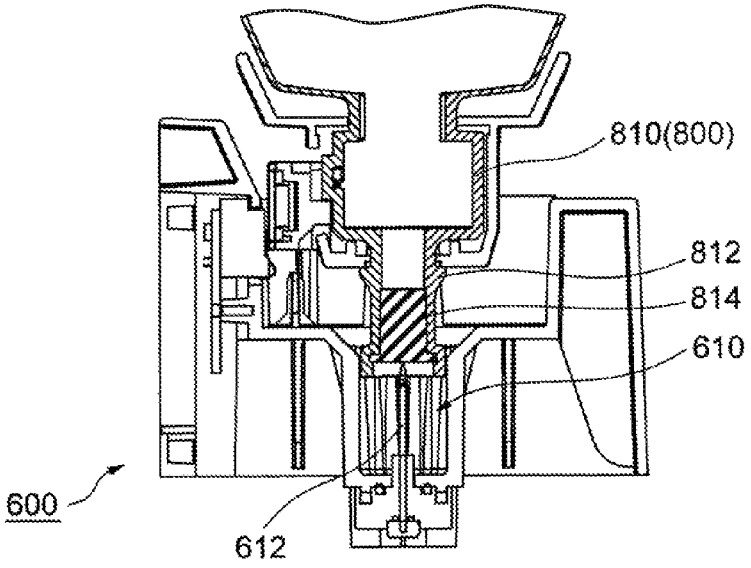
FIG. 36 is a cross-sectional view for explaining the structure of a central deep part of the ink side reservoir.

Attachment of Bottle to Reservoir and Positioning of ROM Unit:

The ink side reservoir 600 has a recess 610 which closely receives the mouth 812 of the bottle 800 (hereinbelow, also referred to as "bottle mouth 812"). The hollow needle 612 stands on the center of the bottom of the recess 610 (FIG. 36).

The bottle mouth 812 is closely fitted into the recess 610, so that the bottle 800 is held by the recess 610 of the reservoir 600.

Figure 37:
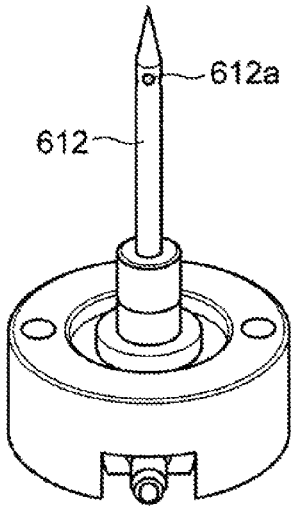
FIG. 37 is a perspective view of a hollow needle for penetrating a rubber stopper on the mouth of the bottle.

The hollow needle 612 penetrates the rubber stopper which closely closes the bottle mouth 812 and the tip part of the hollow needle 612 is exposed inside the bottle 800. As can be seen from FIG. 37, the hollow needle 612 has an opening 612*a* formed on the tip part thereof. Liquid inside the bottle 800 is sucked out through the opening 612*a*. The rubber stopper which closely closes the bottle mouth 812 has a configuration that prevents air inside the bottle 800 from leaking out even when the hollow needle 612 is stuck thereto. Accordingly, for example, when the use of the ink jet printer 2 is suspended for a long period of time, it is possible to perform an operation such that the ink cartridge 400 in use is detached from the ink side reservoir 600 and stored, and the ink cartridge 400 is again inserted into the ink side reservoir 600 when resuming the use of the ink jet printer 2. That is, the rubber stopper which closely closes the bottle mouth 812 functions as an example of an elastic member for trapping air inside the bottle 800 even when the hollow needle 612 is inserted into and removed from the rubber stopper.

Further, liquid inside the recess 610 is discharged from the recess 610 to the outside through a groove 614 (FIGS. 32, 34, and 35) which communicates with the recess 610. Accordingly, even when liquid (especially ink) is accumulated in the recess 610 and the recess 610 is thereby contaminated, it is possible to easily clean the recess 610.

Referring back to FIG. 35, the terminals 602 are disposed on a vertical surface which is adjacent to the recess 610 for receiving the bottle mouth 812. The terminals 602 abut on the terminal contact surfaces 906 (FIG. 20) which are exposed on the outer surface of the ROM holder body 902, and the transmission/reception of information between the printer body 200 and the ROM unit 900 (930) is thereby performed. In this manner, the terminals 602 are disposed on the vertical surface. Therefore, the terminals 602 are not likely to get dirty and also not likely to cause contact failure compared to a case in which the terminals 602 are disposed, for example, on the bottom face of the recess 610. In other words, the terminals 602 are disposed on the surface that is substantially parallel to an insertion direction of the ink cartridge 400 (solvent cartridge 500) into the ink side reservoir 600 (solvent side reservoir 700). Therefore, the terminals 602 have an advantage such that dirt and dust are not likely to adhere or accumulate thereon and also not likely to cause contact failure.

Further, two positioning pins 604 (FIGS. 32, 34 and 35) which stand in regions adjacent to the terminals 602 are positioned. The two positioning pins 604 are received in the two positioning holes 912 formed on the ROM unit 900 or 930 (ROM holder body 902). That is, when the ink cartridge 400 and the solvent cartridge 500 are inserted into the reservoir 600 and the reservoir 700, respectively, the positioning pins 604 on the reservoirs enter the positioning holes 912 of the ROM unit 930 of the ink cartridge 400 and the ROM unit 900 of the solvent cartridge 500. Accordingly, the ROM units 900, 930 are positioned at regular positions on the reservoirs 600, 700.

As described above, each of the ROM units 900, 930 is assembled to the bottle 800 with certain play therebetween. That is, each of the ROM units 900, 930 and the bottle 800 can be relatively displaced in a certain range. On the other hand, the ROM units 900, 930 are positioned at regular positions on the reservoirs 600, 700 by receiving the positioning pins 604 of the reservoirs 600, 700 in the positioning holes 912.

That is, the cartridges 400, 500 for replenishing the continuous type ink jet recording apparatus 2 with an ink or solvent have the ROM units 930, 900 which are supported by the rigid portions of the cartridges so as to be freely movable. When the cartridges 400, 500 are attached to the ink jet recording apparatus 2 (printer body 200), the ROM holder bodies 902 of the ROM units 930, 900 are positioned in the ink jet recording apparatus 2 (printer body 200). Accordingly, even when external force is applied to the cartridges 400, 500, it is possible to reduce the possibility of connection failure in the contact point between the ROM units 930, 900 and the ink jet recording apparatus 2 (printer body 200).

In the embodiment, a combination of the positioning pins 604 and the positioning holes 912 is employed in the positioning. However, any methods such as recess-projection fitting can be employed as long as it is possible to perform relative positioning between the ROM units 900, 930 and the reservoirs 600, 700, particularly, relative positioning between the terminal contact surfaces 906 of the ROM units 900, 930 and the terminals 602 of the reservoirs 600, 700.

As a modification, the ROM unit 900 (930) may be fixedly attached to the rigid portion of the bottle 800, typically, to the bottle neck 810 in a relatively undisplaceable manner. Accordingly, even when external force or shock is applied to the bottle 800, the applied external force or shock is absorbed by the flexible portion of the bottle body 802. Therefore, it is possible to reduce the possibility of connection failure in the contact point between the ROM unit 900 (930) and the ink jet recording apparatus 2 (printer body 200).

As another modification, a flexible portion that allows for relative displacement of the ROM unit 900 (930) may be formed near the rigid portion to which the ROM unit 900 (930) is assembled. Accordingly, even when external force is applied to the cartridge 400 (500), the flexible portion near the rigid portion and the flexible portion of the bottle body 802 can allow for the displacement of the ROM unit 900 (930) which is integrated with the bottle 800. Therefore, it is possible to reduce the possibility of contact failure in the contact point between the ROM unit 900 (930) and the ink jet recording apparatus 2 (printer body 200).

As described above, by employing the structure for suppressing external force from being directly applied to the ROM unit 900 (930) attached to the bottle 800, even when external force is applied to the ink cartridge 400 or the solvent cartridge 500, it is possible to reduce the possibility of adverse effect on a conducting state between the terminals 602 and the terminal contact surfaces 906.

Figure 38:
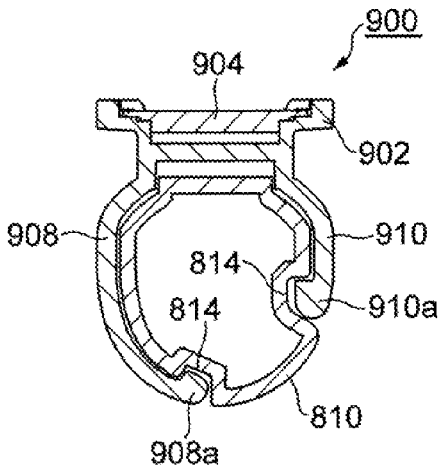
FIG. 38 is a diagram corresponding to FIG. 25 for explaining a first modification of the ROM unit which is attached to the neck of the bottle.
Figure 39:
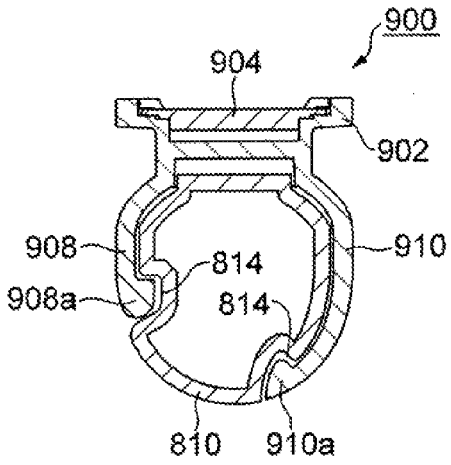
FIG. 39 is a diagram corresponding to FIG. 25 for explaining a second modification of the ROM unit which is attached to the neck of the bottle.

FIGS. 38 to 43 are diagrams for explaining modifications of a specific structure for allowing the ROM unit 900 (930) to be locked to the bottle neck 810. In the above embodiment, the first arm 908 and the second arm 910 of the ROM unit 900 (930) are bilaterally symmetric to each other. However, as illustrated in FIGS. 38 and 39, either one of the first and second arms 908, 910 may be made long and the other one may be made short. Further, the shape of the claw 908*a* of the first arm 908 may differ from the shape of the claw 910*a* of the second arm 910.

Figure 40:
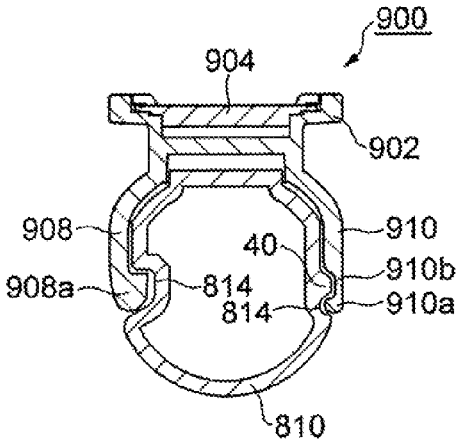
FIG. 40 is a diagram corresponding to FIG. 25 for explaining a third modification of the ROM unit which is attached to the neck of the bottle.

As illustrated in FIG. 40, the claw 910*a* and a recess 910*b* may be formed on the second arm 910, and a projection 40 which enters the recess 910*b* may be formed on the bottle neck 810 so as to be adjacent to the locking groove 814. It is needless to say that the same configuration may be employed in the first arm 908.

Figure 41:
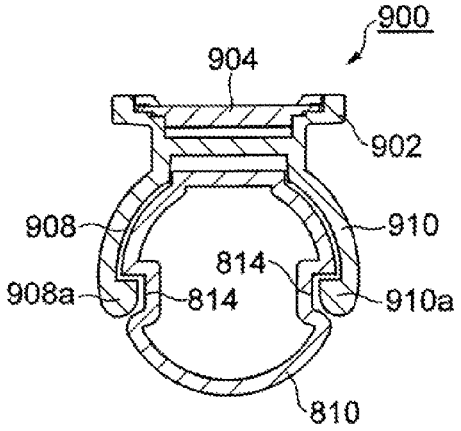
FIG. 41 is a diagram corresponding to FIG. 25 for explaining a fourth modification of the ROM unit which is attached to the neck of the bottle.
Figure 42:
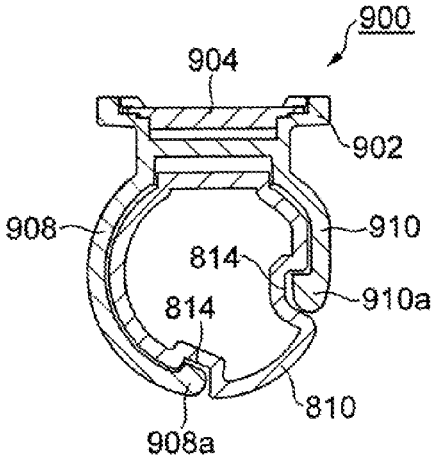
FIG. 42 is a diagram corresponding to FIG. 25 for explaining a fifth modification of the ROM unit which is attached to the neck of the bottle.
Figure 43:
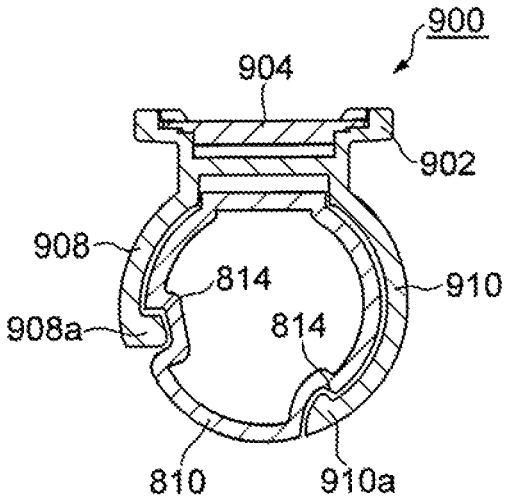
FIG. 43 is a diagram corresponding to FIG. 25 for explaining a sixth modification of the ROM unit which is attached to the neck of the bottle.

FIGS. 38 to 40 illustrate a configuration that prevents, to the utmost, the first and second arms 908, 910 which are engaged with the bottle neck 810 from protruding outward from the circumference of the bottle neck 810. However, as illustrated in FIGS. 41 to 43, at least one of the first and second arms 908, 910 may protrude outward from the circumference of the bottle neck 810.

Other Examples of Misinsertion Prevention Mechanism:

The above misinsertion prevent mechanism is not limited to the combination of the obstruction block 930*a* of the ink ROM unit 930 and the obstruction rib 702 of the solvent side reservoir 700 described above with reference to FIGS. 20, 21, 32, and 33. For example, the above misinsertion prevention mechanism may be composed of a combination of the height dimension of the positioning pins 604 and the depth dimension of the positioning holes 912 which receive the respective positioning pins 604 described above with reference to FIGS. 32, 34, and 35. Specifically, design may be made in such a manner that the depth dimension of the positioning holes 912 of the ink ROM unit 930 is made relatively smaller than that of the solvent ROM unit 900 and the height dimension of the positioning pins 604 of the ink side reservoir 600 is made relatively smaller than that of the solvent side reservoir 700. It is needless to say that the misinsertion prevention mechanism may also be composed of a combination of a large or small diameter of the pins 604 and a large or small diameter of the positioning holes 912.

Figure 44:
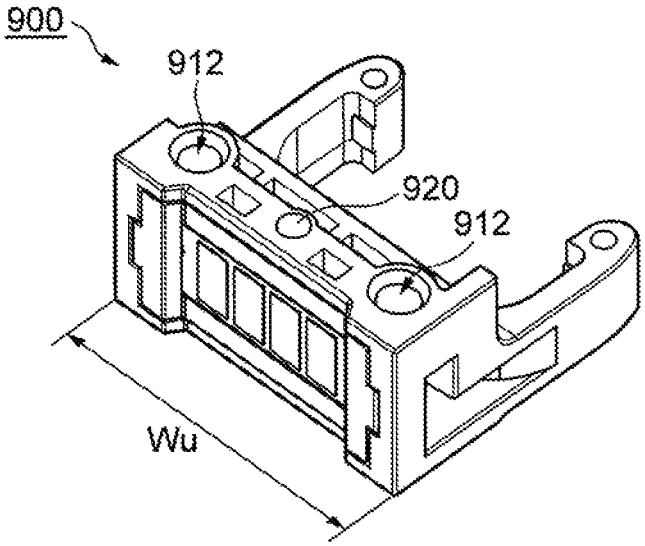
FIG. 44 is a perspective view of the solvent cartridge ROM unit for explaining a second example of a misinsertion prevention mechanism which prevents the ink cartridge from being mistakenly inserted into the solvent side reservoir.
Figure 45:
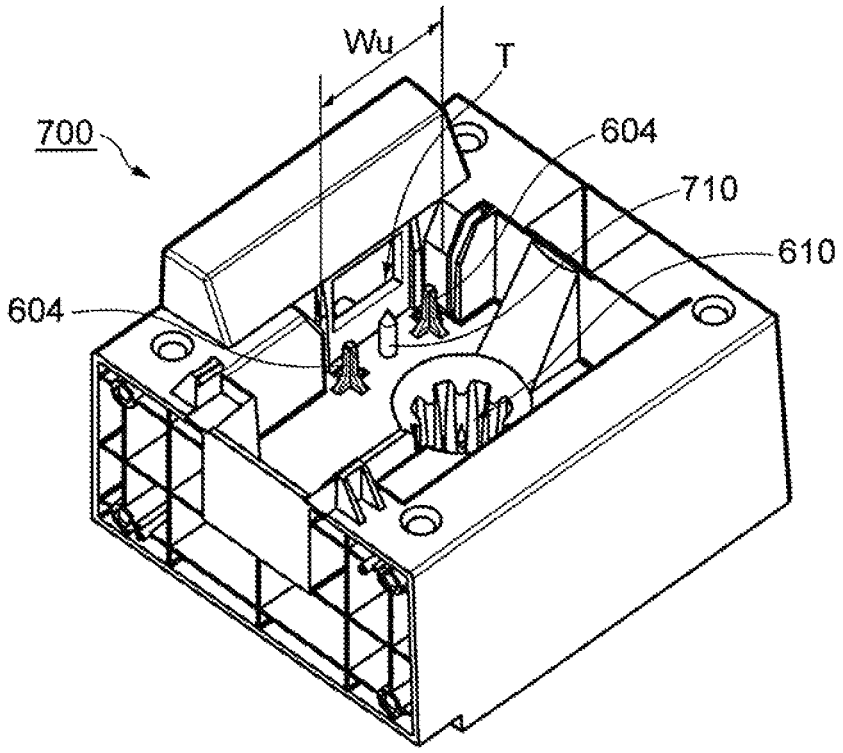
FIG. 45 is a perspective view of the solvent side reservoir for explaining the second example of the misinsertion prevention mechanism as in FIG. 44.

Referring to FIGS. 44 and 45, a misinsertion prevention opening 920 may be formed on the solvent ROM unit 900 in addition to the positioning holes 912 (FIG. 44), and a misinsertion prevention projection 710 which is received in the misinsertion prevention opening 920 may be formed on the solvent side reservoir 700 in addition to the positioning pins 604. It is needless to say that the misinsertion prevention opening 920 is not present in the ink ROM unit 930 and the misinsertion prevention projection 710 is not present in the ink side reservoir 600.

Again referring to FIGS. 44 and 45, the width Wu of a part of the solvent side reservoir 700, the part receiving the solvent ROM unit 900, may be made relatively smaller than that of the ink side reservoir 600 and the width Wu in the solvent ROM unit 900 may also be made smaller than that in the ink ROM unit 930 to thereby constitute the misinsertion prevention mechanism.

Referring to FIG. 31, the misinsertion prevention mechanism may be composed of the height position or the height dimension H of the bridge 820*f* of the attachment 820 and the length dimension L of the vertically-extending slits 18 of the reservoirs 600, 700. Specifically, the height position of the bridge 820*f* of the attachment 820 of the solvent cartridge 500 may be displaced upward or the height dimension H may be extended upwardly as compared to that of the cartridge 400, and the length dimension L of the slits 18 of the solvent side reservoir 700 may be made smaller than those of the ink side reservoir 600 to thereby constitute the misinsertion prevention mechanism. As a modification, the height position of a projection or convex strip extending in the height direction which is located in a relatively hard portion of the solvent cartridge 500 may be made relatively higher than that of the ink cartridge 400, and the height position of the lower edge of a slit in the solvent reservoir 700, the slit receiving the projection or the convex strip and guiding the insertion of the solvent cartridge 500, may be made higher than that of the ink side reservoir 600 to thereby constitute the misinsertion prevention mechanism.

It is needless to say that the misinsertion prevention mechanism may be composed of a combination of a large or small width of the slits 18 and a large or small width dimension of projections or convex strips received in the slits 18.

What is claimed is:

1. A cartridge for a continuous type ink jet recording apparatus, the cartridge being detachably received in a cartridge receiving unit of the continuous type ink jet recording apparatus so as to replenish the continuous type ink jet recording apparatus with an ink or solvent, the cartridge comprising:

a body portion having an internal space storing an ink or solvent therein, the body portion at least partially having flexibility;

a rigid portion having a fluid path inside thereof and projecting in an axial direction from the body portion, the fluid path communicating with the internal space of the body portion, the rigid portion having a smaller diameter and higher rigidity than the body portion; and a recording medium unit having a recording medium capable of recording information about the cartridge, wherein the recording medium unit is detachably engaged with the rigid portion at a locking position by a recess-boss engagement so as to be locked in the axial direction and in a circumferential direction of the rigid portion by the recess-boss engagement, and wherein the recording medium unit has a first surface having a first terminal of the recording medium, the first surface being substantially parallel to an insertion direction of the cartridge, the first terminal being in contact with a second terminal disposed on a second surface provided at the cartridge receiving unit when insertion of the cartridge into the cartridge receiving unit is completed, the second surface being substantially parallel to the insertion direction of the cartridge.

2. The cartridge for the ink jet recording apparatus according to claim 1, further comprising:

a mouth having a discharge port for discharging the ink or solvent stored in the body portion to the outside; and a neck interposed between the mouth and the body portion, the neck having a larger diameter than the mouth, wherein the neck constitutes the rigid portion and the recording medium unit is disposed on the neck.

3. The cartridge for the ink jet recording apparatus according to claim 2, wherein the mouth, the neck, and the body portion are integrally molded.

4. The cartridge for the ink jet recording apparatus according to claim 1, wherein the body portion has a plurality of flexible side faces and a plurality of corner portions shared by adjacent ones of the side faces, and the side faces are deformed prior to the corner portions in the body portion in response to outflow of the ink or solvent stored in the body portion to the outside.

5. The cartridge for the ink jet recording apparatus according to claim 1, further comprising:

a mouth for being received in the cartridge receiving unit; and wherein the mouth constitutes the rigid portion, and when the ink or solvent inside the body portion is sucked out by a pump of the ink jet recording apparatus, the body portion is deformable to reduce the volume thereof in response to the suction.

6. The cartridge for the ink jet recording apparatus according to claim 1, wherein the cartridge further includes a mouth for being received in the cartridge receiving unit and the body portion is deformable to reduce the volume thereof in response to suction performed by a pump of the ink jet recording apparatus, the mouth constitutes the rigid portion, and the mouth is sealed by a rubber stopper that allows a hollow needle standing on a bottom of the cartridge receiving unit to penetrate therethrough when the mouth is received by the cartridge receiving unit.

7. The cartridge for the ink jet recording apparatus according to claim 1, wherein the recording medium records an identification information specific to the cartridge, the identification information being read through the first terminal and the second terminal by the continuous type ink jet recording apparatus when the first terminal is in contact with the second terminal.

8. The cartridge for the ink jet recording apparatus according to claim 1, wherein when insertion of the cartridge into the cartridge receiving unit is completed, the ink jet recording apparatus sucks out the ink or solvent from the cartridge through the fluid path extended along the insertion direction of the cartridge in the rigid portion.

9. The cartridge for the ink jet recording apparatus according to claim 1, wherein the recording medium unit has a misinsertion prevention mechanism for preventing the cartridge from being incorrectly inserted into the cartridge receiving unit, the misinsertion prevention mechanism interfering with the cartridge receiving unit during insertion of the cartridge.

10. The cartridge for the ink jet recording apparatus according to claim 9, wherein the cartridge is an ink cartridge storing the ink therein, the ink cartridge is completely inserted into an ink side cartridge receiving unit, and the misinsertion prevention mechanism provided in the ink cartridge interferes with a solvent side cartridge receiving unit during insertion of the ink cartridge, to prevent the ink cartridge from being incorrectly inserted into the solvent side cartridge receiving unit.

11. The cartridge for the ink jet recording apparatus according to claim 10, wherein the misinsertion prevention mechanism is a first obstruction portion provided in the ink cartridge, the first obstruction portion interfering with a second obstruction portion provided in the solvent side cartridge receiving unit during insertion of the ink cartridge.

12. The cartridge for the ink jet recording apparatus according to claim 10, wherein the ink cartridge is the same size and shape as the solvent cartridge with the exception of the recording medium unit.

13. The cartridge for the ink jet recording apparatus according to claim 12, wherein a shape of the recording medium unit is different between the ink cartridge and the solvent cartridge.

14. The cartridge for the ink jet recording apparatus according to claim 1, further comprising:

an attachment configured to be attached to the rigid portion, the attachment having a half-housing shape which covers a side face of the body portion, wherein the cartridge is received in the cartridge receiving unit with the attachment attached to the rigid portion.

15. A bottle detachably received in a reservoir of a continuous type ink jet recording apparatus so as to replenish the ink jet recording apparatus with an ink or solvent, the bottle comprising:

a bottle body having an internal space storing an ink or solvent therein, the bottle body at least partially having flexibility; and a mouth for discharging the ink or solvent inside the bottle body to the outside, the mouth projecting from the bottle body, wherein the mouth has higher rigidity than the bottle body, the mouth has an attachment portion to which a recording medium unit having a recording medium capable of recording information about the bottle is detachably fixed by a recess-boss engagement, the bottle is received in the reservoir with the recording medium unit fixed to the attachment portion by the recess-boss engagement so as to be locked in a circumferential direction about the mouth and in an axial direction of the mouth and bottle body by the recess-boss engagement, and the recording medium unit has a first surface having a first terminal of the recording medium, the first surface being substantially parallel to an insertion direction of the cartridge, the first terminal being in contact with a second terminal disposed on a second surface provided at a cartridge receiving unit when insertion of the cartridge into the cartridge receiving unit is completed, the second surface being substantially parallel to the insertion direction of the cartridge.

16. The bottle according to claim 15, wherein the bottle is a synthetic resin product, and the volume of the bottle body is reduced in a specified form when the bottle body is deformed by adjusting the thickness of the bottle body in each part.

17. The bottle according to claim 15, wherein the mouth has a hard bottle neck located adjacent to the bottle body, and the bottle neck has a locking groove into which the recording medium unit is locked.

18. A bottle detachably received in a reservoir of a continuous type ink jet recording apparatus so as to replenish the ink jet recording apparatus with an ink or solvent, the bottle comprising:

a bottle body having an internal space storing an ink or solvent therein, the bottle body at least partially having flexibility; and a mouth for discharging the ink or solvent inside the bottle body to the outside, the mouth projecting from the bottle body, wherein the mouth has higher rigidity than the bottle body, the mouth has an attachment portion to which a recording medium unit having a recording medium capable of recording information about the bottle is attached, and the bottle is received in the reservoir with the recording medium unit attached to the attachment portion, wherein the mouth has a hard bottle neck located adjacent to the bottle body, and the bottle neck has a locking groove into which the recording medium unit is locked, and the recording medium unit includes a holder body housing the recording medium therein and two arms extending from the holder body with the neck interposed therebetween, and each of the arms has a claw on the tip so as to engage with the locking groove.

19. The bottle according to claim 18, wherein when the claw of each of the two arms is engaged with a step of the locking groove of the bottle neck, the recording medium unit is relatively displaceable with respect to the bottle neck and the recording medium unit is positioned with respect to the reservoir.

* * * * *